US010647078B2

(12) United States Patent
Ishizuka et al.

(10) Patent No.: US 10,647,078 B2
(45) Date of Patent: May 12, 2020

(54) FOLDER-GLUER

(71) Applicant: KABUSHIKI KAISHA ISOWA, Nagoya-shi, Aichi (JP)

(72) Inventors: Mitsuhiro Ishizuka, Minokamo (JP); Yukiomi Suzuki, Kasugai (JP)

(73) Assignee: KABUSHIKI KAISHA ISOWA, Nagoya-shi (JP)

( * ) Notice: Subject to any disclaimer, the term of this patent is extended or adjusted under 35 U.S.C. 154(b) by 580 days.

(21) Appl. No.: 15/041,490

(22) Filed: Feb. 11, 2016

(65) Prior Publication Data

US 2016/0243784 A1 Aug. 25, 2016

(30) Foreign Application Priority Data

Feb. 20, 2015 (JP) ..... 2015-031993

(51) Int. Cl.

| | |
|---|---|
| ***B31B 1/02*** | (2006.01) |
| ***B31B 50/36*** | (2017.01) |
| ***B31B 50/64*** | (2017.01) |
| ***B31B 50/04*** | (2017.01) |
| ***B31B 50/58*** | (2017.01) |
| ***B31B 50/00*** | (2017.01) |
| ***B31B 50/62*** | (2017.01) |
| *B31B 50/26* | (2017.01) |
| *B31B 100/00* | (2017.01) |

(Continued)

(52) U.S. Cl.

CPC ..... *B31B 50/36* (2017.08); *B31B 50/006* (2017.08); *B31B 50/042* (2017.08); *B31B 50/044* (2017.08); *B31B 50/58* (2017.08); *B31B 50/62* (2017.08); *B31B 50/64* (2017.08); *B31B 50/26* (2017.08); *B31B 2100/00* (2017.08); *B31B 2110/35* (2017.08); *B31B 2120/302* (2017.08)

(58) Field of Classification Search

CPC ..... B31B 50/36; B31B 50/58; B31B 50/62
See application file for complete search history.

(56) References Cited

U.S. PATENT DOCUMENTS 3,611,884 A * 10/1971 Hottendorf ..... B31F 1/10 493/270
5,019,026 A * 5/1991 Jaton ..... B65H 9/166 493/125

(Continued)

FOREIGN PATENT DOCUMENTS

JP 4493052 B1 6/2010

*Primary Examiner* — Michelle Lopez
*Assistant Examiner* — Chinyere J Rushing-Tucker
(74) *Attorney, Agent, or Firm* — Brinks Gilson & Lione

(57) ABSTRACT

Disclosed is a folder-gluer comprises: a conveyance device configured to convey a corrugated paperboard sheet; a pair of bending bars configured to bend a first panel and a fourth panel of the corrugated paperboard sheet from 0 degree to about 90 degrees; a pair of bending plates provided in a zone where the first and fourth panels are bent from 0 degree to about 90 degrees, and configured such that distal ends thereof come into contact, respectively, with crease lines of the first and fourth panels or vicinities of the crease lines, wherein each of the bending plates is configured to be pushed and moved outwardly in a width direction, by a push-out device; a detector configured to detect a position of the corrugated paperboard sheet; and a control device configured to control the push-out device.

11 Claims, 20 Drawing Sheets

(51) Int. Cl.
*B31B 120/30* (2017.01)
*B31B 110/35* (2017.01)

(56) References Cited

U.S. PATENT DOCUMENTS

| | | | | | |
|---|---|---|---|---|---|
| 5,151,075 | A * | 9/1992 | Beaulieu | B31B 50/00 | 271/144 |
| 5,827,162 | A * | 10/1998 | Rubin | B31B 50/00 | 493/178 |
| 2002/0193219 | A1* | 12/2002 | Okamoto | B31B 50/00 | 493/79 |
| 2010/0190627 | A1* | 7/2010 | Ishizuka | B31B 50/00 | 493/128 |
| 2012/0053036 | A1* | 3/2012 | Bruns | B31B 50/00 | 493/128 |
| 2015/0024917 | A1* | 1/2015 | Nadachi | B31B 50/00 | 493/53 |

* cited by examiner

FOLDER-GLUER

RELATED APPLICATIONS

This application claims priority under 35 U.S.C. § 119 to Japanese Patent Application No. 2015-031993 filed on Feb. 20, 2015, the entire content of which is hereby incorporated by reference.

BACKGROUND OF THE INVENTION

Technical Field

The present invention relates to a folder-gluer, and more particularly to a folder-gluer for folding and gluing a corrugated paperboard sheet having four panels and a joint flap.

Background Art

Generally, a corrugated paperboard box making machine is configured to perform slotting and creasing to thereby form, in a corrugated paperboard sheet, a plurality of slots and crease lines each extending in a conveyance direction. The corrugated paperboard sheet is designed to be formed as a box, i.e., has four panels and a joint flap. A folder-gluer is one processing unit comprised in the corrugated paperboard box making machine, and configured to fold endmost two of the four panels of the corrugated paperboard sheet by 180 degrees, and glue one of the folded panels to the joint flap. During conveyance of the corrugated paperboard sheet at high speed, each of the two endmost panels is folded through contact between an outside surface of the panel and a bending bar or bending belt.

With reference to FIGS. 17 to 19, one example of a conventional folder-gluer will be described. A conventional folder-gluer 90 comprises: a frame 92; a conveyance device (upper conveyor belt and a lower conveyor belt) 94 for conveying a corrugated paperboard sheet SS comprising four panels P1 to P4; a first bending station 96 for bending each of the endmost panels P1, P4 of the corrugated paperboard sheet SS from 0 degree to about 90 degrees; and a second bending station (not illustrated) for bending each of the endmost panels from about 90 degrees to 180 degrees.

In order to bend the two endmost panels P1, P4 of the corrugated paperboard sheet SS from 0 degree to about 90 degrees, the first bending station 96 illustrated in FIGS. 17 and 18 employs a pair of bending bars 98 configured to come into contact with respective outside surfaces of the two endmost panels P1, P4, and a pair of bending plates 100 each configured to allow a respective one of the two endmost panels to be bent along an associated crease line. Each of the bending plates 100 is arranged such that a distal end (upper end) thereof is located slightly inwardly in a width direction with respect to a position of the crease line along which the panel P1, P4 is to be bent. The reason is as follows. Since the corrugated paperboard sheet SS has a certain thickness, if the distal end of the bending plate 100 is located just at the position of the crease line, the corrugated paperboard sheet SS bulges along with the bending, the distal end is pinched between edges of the bulged portion of the corrugated paperboard sheet SS, and resulting friction makes it impossible to successfully convey the corrugated paperboard sheet SS. The above arrangement is intended to prevent the occurrence of this situation.

As above, there is a slight distance between the distal end of the bending die plate 100 and the position of the crease line, so that, due to contact frictional resistance between respective ones of the bending bars 98 and conveyance-directional leading edge regions (downstream edge regions) of the two endmost panels P1, P4 of the corrugated paperboard sheet SS being conveyed, a fold line of each of the two endmost panels is shifted inwardly in the width direction with respect to the position of the crease line, in the leading edge region of the corrugated paperboard sheet SS, and thereby each of the two endmost panels P1, P4 has a posture where it is inclined outwardly in the width direction (see FIG. 18). Then, the corrugated paperboard sheet having the two endmost panels bent in the inclined posture is introduced into a last-half (downstream) zone of the folder-gluer, and each of the two endmost panels is further bent from about 90 degrees to 180 degrees, while being guided by a corresponding one of two sets of a plurality of gauge rollers (guide rollers) disposed on both sides of the corrugated paperboard sheet. In this case, the bending is progressed while each of the two endmost panels P1, P4 is kept in the inclined posture, so that a box is formed such that the fold lines of the two endmost panels are inclined (skewed) in a fishtail shape toward an upstream side in the conveyance direction. This "fishtail" problem is more likely to occur, as the corrugated paperboard sheet has a larger box depth dimension in the conveyance direction.

FIG. 19 illustrates a folded corrugated paperboard sheet SS produced by the above folder-gluer, wherein the fishtail occurs in this corrugated paperboard sheet SS. Specifically, a gap between edge regions of the two endmost panels on a downstream side in the conveyance direction is "−A", and a gap between edge regions of the two endmost panels on the upstream side is "B", so that a difference between the upstream-side and downstream-side gaps between the two endmost panels is "A+B". That is, in the folded corrugated paperboard sheet SS, the fold lines obliquely extend in a direction from the downstream side to the upstream side to form a fishtail shape.

With a view to preventing the occurrence of the fishtail in a corrugated paperboard sheet, various devices have heretofore been invented. For example, a folder-gluer disclosed in JP 4493052 B (Patent Document 1) comprises a pair of pressing members which are arranged in a width direction perpendicular to a conveyance direction of a corrugated paperboard sheet being folded, and configured to press connection regions of two endmost panels of the corrugated paperboard sheet, while determining a timing of the pressing, to thereby correct the fishtail.

SUMMARY OF INVENTION

Technical Problem

However, because the folder-gluer disclosed in the Patent Document 1 is configured to press the connection regions of the two endmost panels by the pair of pressing members, the connection regions of the two endmost panels are likely to undergo deformation, scratching or the like, and it is difficult to obtain a sufficient fishtail correction effect.

In view of solving the above problem of the conventional technique, it is therefore an object of the present invention to provide a folder-gluey capable of, in a first half of a folding process, bending each of endmost two of four panels of a corrugated paperboard sheet in such a manner as to form a fold line thereof in an inclination-free state, and, in a last half of the folding process, continuing the bending of the two endmost panels, to thereby produce a box free from the fishtail.

Solution to Technical Problem

In order to achieve the above object, the present invention provides a folder-gluer for, with respect to a corrugated paperboard sheet having first to fourth panels and a joint flap serially connected together through respective connection regions, folding each of the first panel and the fourth panel in the connection region thereof and gluing the folded first and fourth panels together through the joint flap. The folder-gluer comprises: a conveyance device configured to convey the corrugated paperboard sheet; a pair of first bending devices configured to come into contact with respective outside surfaces of the first panel and the fourth panel of the corrugated paperboard sheet being conveyed by the conveyance device, to bend the first and fourth panels from 0 degree to about 90 degrees; a pair of second bending devices configured to come into contact with the respective outside surfaces of the first panel and the fourth panel of the corrugated paperboard sheet being conveyed by the conveyance device to bend the first and fourth panels from about 90 degrees to 180 degrees; a pair of bending members provided in a zone where the first and fourth panels are bent from 0 degree to about 90 degrees, and configured such that distal ends thereof come into contact, respectively, with a crease line formed in a reverse surface of the first panel or a vicinity of the crease line, and a crease line formed in a reverse surface of the fourth panel or a vicinity of the crease line, wherein each of the bending members is movable outwardly in a width direction by a given distance; a detection device provided upstream of the bending members, and configured to detect a position of the corrugated paperboard sheet being conveyed; a push-out device configured to push and move each of the bending members outwardly in the width direction by a given distance; and a control device during a given period of time after the position of the corrugated paperboard sheet being conveyed is detected by the detection device, to control the push-out device to push and move each of the bending members outwardly in the width direction by the given distance to thereby expand a downstream region of each of the first and fourth panels in the width direction.

In the folder-gluer of the present invention having the above feature, the pair of bending members are provided in a zone where the first and fourth panels are bent from 0 degree to about 90 degrees, and configured such that distal ends thereof come into contact, respectively, with a crease line formed in a reverse surface of the first panel or a vicinity of the crease line, and a crease line formed in a reverse surface of the fourth panel or a vicinity of the crease line, and the push-out device is configured to move each of the bending members outwardly in the width direction by a given distance, whereby, when the first and fourth panels are bent from 0 degree to about 90 degrees by the first bending devices, a downstream region of each of the first and fourth panels can be expanded in the width direction. Therefore, the present invention can prevent the occurrence of the conventional problem "fishtail".

Preferably, in the folder-gluer of the present invention, each of the bending members is configured such that a downstream portion thereof is swingable in the width direction, about an upstream end thereof serving as a support point.

In the folder-gluer having this feature, each of the bending members is configured such that a downstream portion thereof is swingable in the width direction, about an upstream end thereof serving as a support point, so that each of the first and fourth panels can be expanded outwardly in the width direction so as to allow a fold line of each of the first and fourth panels to be inclined in a direction opposite to an inclination causing the occurrence of the fishtail. This makes it possible to more effectively prevent the occurrence of the fishtail.

Preferably, the folder-gluer of the present invention further comprises a wheel member provided widthwise outside each of the bending members, and configured to come into contact with the outside surface of an associated one of the first and fourth panels at a position of a fold line thereof.

In the folder-gluer having this feature, while the first and fourth panels are expanded outwardly in the width direction by the bending members, the wheel member comes into contact with the outside surface of an associated one of the first and fourth panels at a position of a fold line thereof, to thereby suppress uplift of the associated one of the first and fourth panels, which would otherwise occur during bending thereof. This makes it possible to more effectively prevent the occurrence of the fishtail.

Preferably, in the above folder-gluer, the wheel member comprises a cylindrical portion and a flange portion provided on an upper side of the cylindrical portion, wherein the wheel member is configured such that an outer peripheral surface of the cylindrical portion and a lower surface of the flange portion come into contact with the outside surface of the associated one of the first and fourth panels at the position of the fold line thereof.

In the folder-gluer having this feature, the outer peripheral surface of the cylindrical portion and the lower surface of the flange portion come into contact with the outside surface of the associated one of the first and fourth panels at the position of the fold line thereof, so that it becomes possible to suppress uplift of the associated one of the first and fourth panels, which would otherwise occur during bending thereof, and more effectively prevent the occurrence of the fishtail.

Preferably, in the above folder-gluer, the wheel member is provided along a conveyance direction of the corrugated paperboard sheet at a position where a bending angle of the corrugated paperboard sheet reaches 80 to 90 degrees.

In the folder-gluer having this feature, the wheel member is provided at a position where the bending angle of the corrugated paperboard sheet reached 80 to 90 degrees, i.e., a position where the fishtail can occur. This makes it possible to reliably prevent the occurrence of the fishtail.

Preferably, in the above folder-gluer, the wheel member is a drive wheel configured to rotate in a direction causing the corrugated paperboard sheet to be conveyed.

In the folder-gluer having this feature, the wheel member is composed of a drive wheel, so that the wheel member can suppress uplift of the associated one of the first and fourth panels, which would otherwise occur during bending thereof, while smoothly conveying the corrugated paperboard sheet. This makes it possible to more effectively prevent the occurrence of the fishtail.

Preferably, in the folder-gluer of the present invention, the push-out device is an air cylinder configured to push and move each of the bending members outwardly in the width direction by means of high-pressure air.

In the folder-gluer having this feature, an air cylinder is employed to push each of the bending members outwardly in the width direction, so that it becomes possible to provide the push-out device with a simple structure.

Alternatively, the push-out device may be a servomotor configured to push and move each of the bending members outwardly in the width direction.

In this case, a servomotor is employed to push and move each of the bending members outwardly in the width direction, so that it becomes possible to accurately set an amount of movement toward an outward side in the width direction and easily change the amount of the movement.

Preferably, in the folder-gluer of the present invention, a movement distance of each of the bending members toward an outward side in the width direction is variable depending on properties of the corrugated paperboard sheet.

In the folder-gluer having this feature, the movement distance of each of the bending members toward an outward side in the width direction is variable depending on properties (sheet size, material, etc.) of the corrugated paperboard sheet. This makes it possible to more reliably prevent the occurrence of the fishtail.

Preferably, in the folder-gluer of the present invention, a length of each of the bending members in a conveyance direction of the corrugated paperboard sheet is greater than a box depth dimension of the corrugated paperboard sheet to be conveyed.

In the folder-gluer having this feature, the length of each of the bending members in the conveyance direction is greater than the box depth dimension of the corrugated paperboard sheet to be conveyed, so that it becomes possible to prevent the occurrence of the fishtail, over the overall length of the fold line of each of the first and fourth panels.

Preferably, in the above folder-gluer, the given period of time during which, under control of the control device, the push-out device pushes each of the bending members outwardly in the width direction by a given distance is a period of time during which a downstream portion of the corrugated paperboard sheet having one-half of a box depth dimension thereof passes through a position of the wheel member.

In the folder-gluer having this feature, the push-out device pushes each of the bending members outwardly in the width direction by a given distance, in a period of time during which a downstream portion of the corrugated paperboard sheet having one-half of a box depth dimension thereof passes through a position of the wheel member, so that it becomes possible to eliminate a situation triggering the formation of the fishtail.

Preferably, in the above folder-gluer, a movement distance of each of the bending members toward an outward side in the width direction is approximately one-half of a widthwise dimension of a slot of the corrugated paperboard sheet.

In the folder-gluer having this feature, the movement distance of each of the bending members toward an outward side in the width direction is approximately one-half of a widthwise dimension of a slot of the corrugated paperboard sheet, so that it becomes possible to prevent a certain level of fishtail which becomes a practical problem.

Effect of Invention

In the folder-gluer of the present invention, in a first half of a folding process, each of endmost two of four panels of a corrugated paperboard sheet can be bent in such a manner as to form a fold line thereof in an inclination-free state, and, in a last half of the folding process, the bending of the two endmost panels can be continued to thereby produce a box free from the fishtail.

DETAILED DESCRIPTION OF THE PREFERRED EMBODIMENTS

With reference to the accompanying drawings, a folder-gluer according to one embodiment of the present invention will now be described.

The folder-gluer is a part of a corrugated paperboard box making machine in which a large number of processing units including the folder-gluer are disposed along a conveyance direction of a corrugated paperboard sheet. The corrugated paperboard box making machine comprises, on an upstream side of the folder-gluer, a corrugated paperboard sheet feeding unit, a printing unit, and a creaser-slotter unit for creasing and slotting a corrugated paperboard sheet, and further comprises, on a downstream side of the folder-gluer, a counter-ejector unit for accumulating and ejecting a plurality of folded and glued corrugated paperboard sheets.

Figure 1:
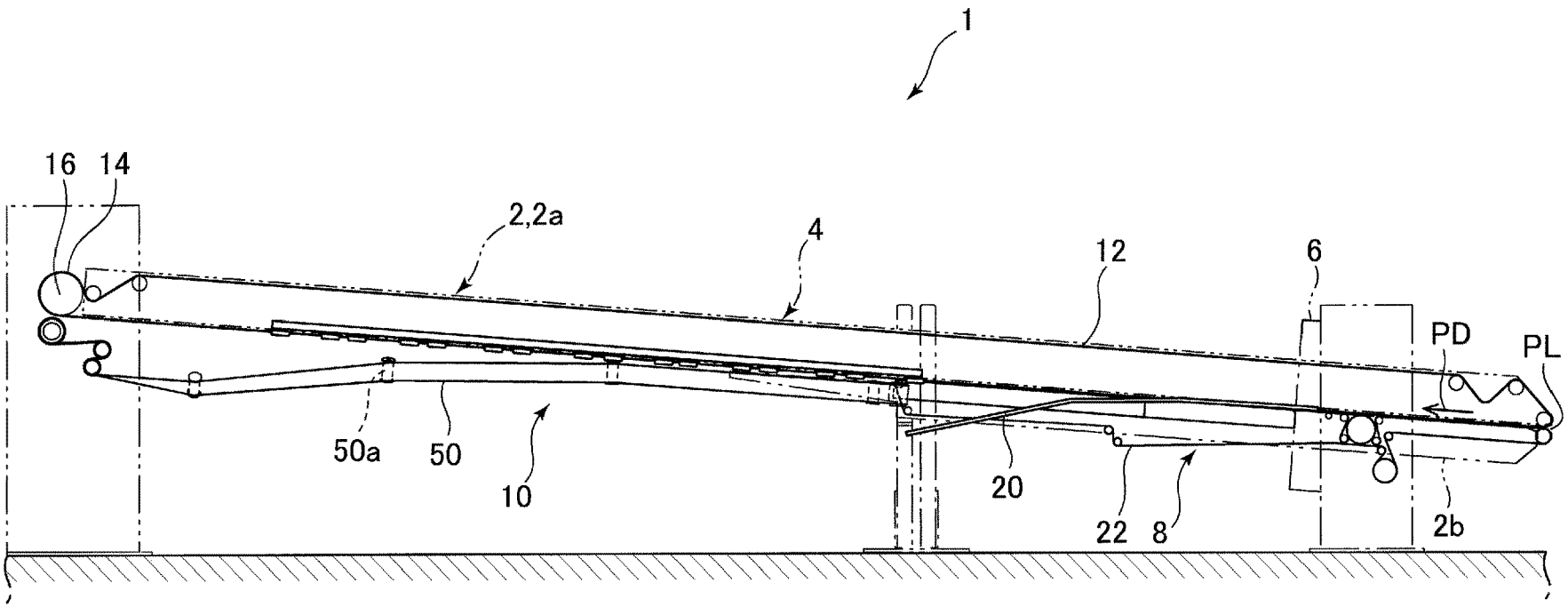
FIG. 1 is a schematic diagram illustrating an overall structure of a folder-gluer according to one embodiment of the present invention.
Figure 2:
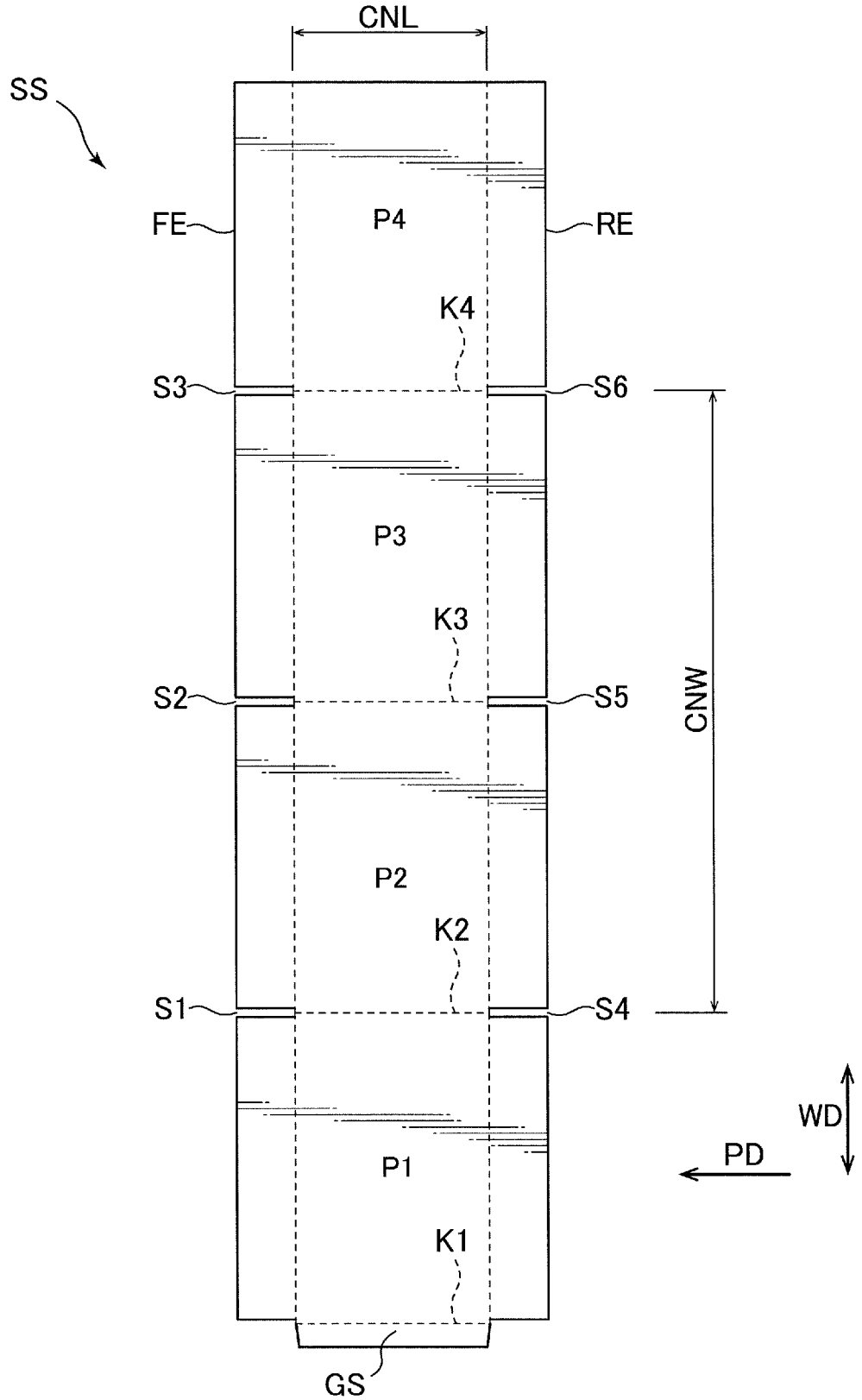
FIG. 2 is a top plan view illustrating a both-side flap type corrugated paperboard sheet.

With reference to FIGS. 1 and 2, an overall structure of the folder-gluer according to this embodiment will be described. FIG. 1 is a schematic diagram illustrating an overall structure of the folder-gluer according to this embodiment, and FIG. 2 is a top plan view illustrating a both-side flap type corrugated paperboard sheet.

As illustrated in FIG. 1, the folder-gluer 1 according to this embodiment is disposed along a conveyance direction PD and configured to fold and glue a both-side flap type corrugated paperboard sheet SS (see FIG. 2).

As illustrated in FIG. 2, the both-side flap type corrugated paperboard sheet SS has: first to fourth panels P1 to P4 along a sheet width direction WD perpendicular to the conveyance direction PD; and a joint flap GS on a left side of the first panel P1. The creaser-slotter unit (not illustrated) disposed on the upstream side of the folder-gluer 1 is operable to form four crease lines K1 to K4, respectively, in a connection region between the first panel P1 and the joint flap GS, and three connection regions between respective adjacent ones of the first to fourth panels P1 to P4, and to form three slit-like slots S1 to S3 in a region adjacent to a leading edge FE of the corrugated paperboard sheet SS, and three slit-like slots S4 to S6 in a region adjacent to a trailing edge RE of the corrugated paperboard sheet SS. Each of the connection regions has a given depth dimension CNL in a direction parallel to the conveyance direction PD, and a distance between the connection region formed with the crease line K2 and the connection region formed with the crease line K4 is a given widthwise distance CNW along the sheet width direction WD. The crease lines K1 to K4 are formed in respective reverse surfaces of the first to fourth panels P1 to P4.

As illustrated in FIG. 1, the folder-gluer 1 comprises: a frame 2; a conveyance device 4 for conveying the corrugated paperboard sheet SS along a conveyance pathway PL; a glue application device 6 for applying glue to the joint flap GS of the corrugated paperboard sheet SS; a first bending station 8 for bending the endmost, first and fourth panels P1, P4 of the corrugated paperboard sheet SS from its flat state (0 degree) to about 90 degrees; and a second bending station 10 for bending the first and fourth panels P1, P4 from about 90 degrees to 180 degrees.

The frame 2 comprises an upper frame 2*a* and a lower frame 2*b*, which are configured to allow aforementioned various components to be attached thereto.

The conveyance device 4 comprises a pair of upper conveyor belts 12 provided on right and left sides of the conveyance pathway PL, in a tensioned state. The upper conveyor belts 12 are disposed along and above the conveyance pathway PL, over the overall length of the folder-gluer 1, and only a part thereof corresponding to the second bending station 10 is formed as a suction type configured to convey the corrugated paperboard sheet SS while suction-holding an upper surface of the corrugated paperboard sheet SS. A conveyance motor 14 is provided to drive the upper conveyor belts 12, and a conveyance amount detector 16 is coupled to a rotary shaft of the conveyance motor 14 to detect a conveyance amount by the upper conveyor belts 12. A distance between the upper conveyor belts 12 in the sheet width direction WD is adjustable depending on the given widthwise distance CNW of the corrugated paperboard sheet SS.

The glue application device 6 is disposed adjacent to a feed port of the folder-gluer 1 through which the corrugated paperboard sheet SS is fed into the folder-gluer 1. The glue application device 6 is configured to apply glue to the joint flap GS of the corrugated paperboard sheet SS being conveyed from the feed port. The joint flap GS applied with glue is bonded to the fourth panel P4 by a joining roller, when the corrugated paperboard sheet SS is discharged from the folder-gluer 1.

Figure 3:
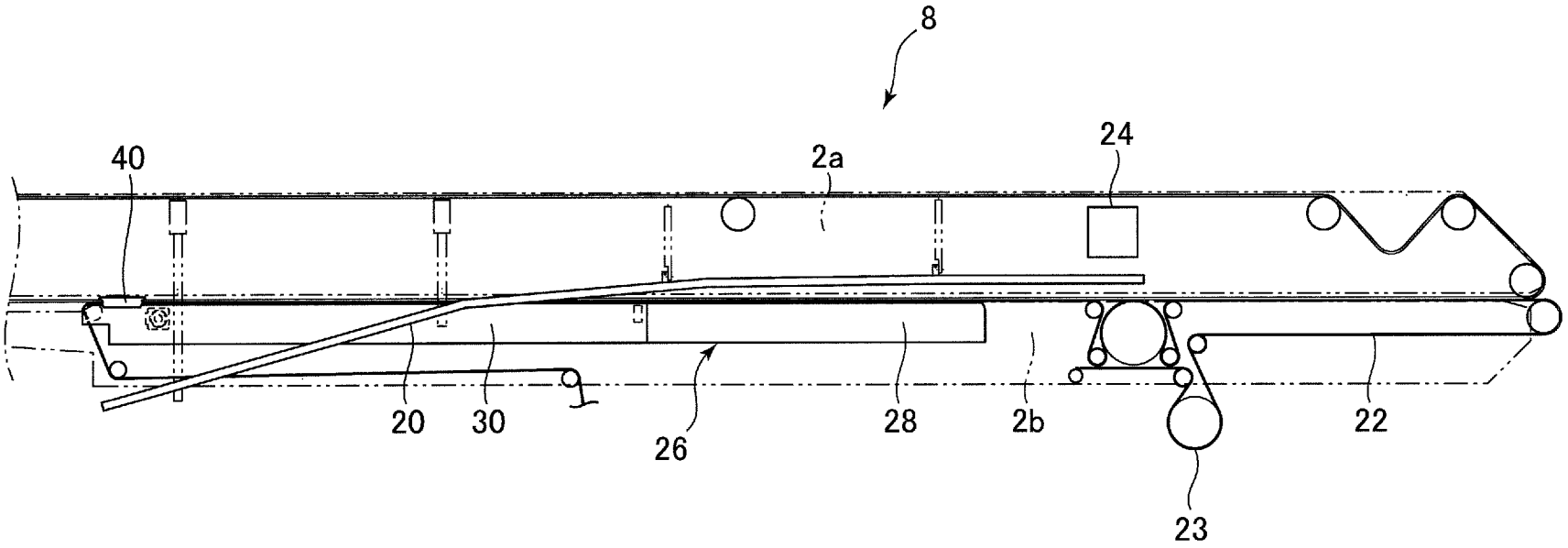
FIG. 3 is a side view illustrating a first bending station of the folder-gluer according to this embodiment.
Figure 4:
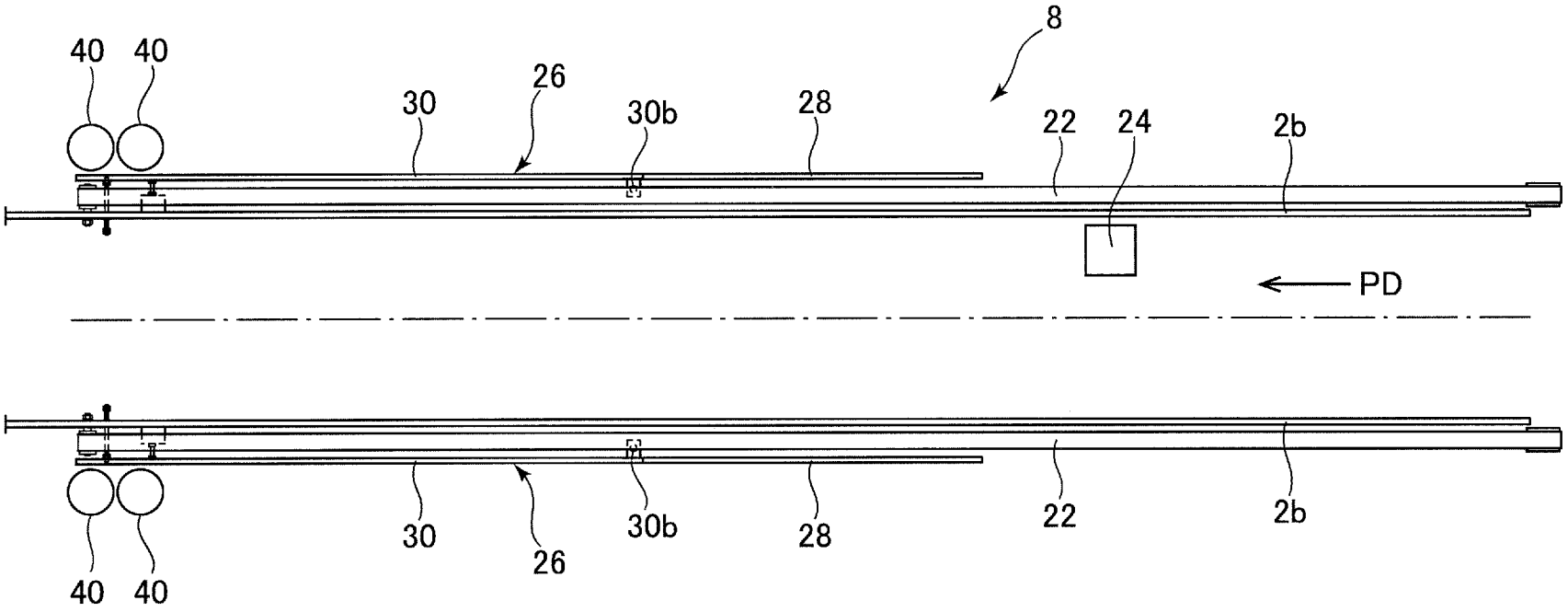
FIG. 4 is a top plan view illustrating the first bending station in FIG. 3.
Figure 5:
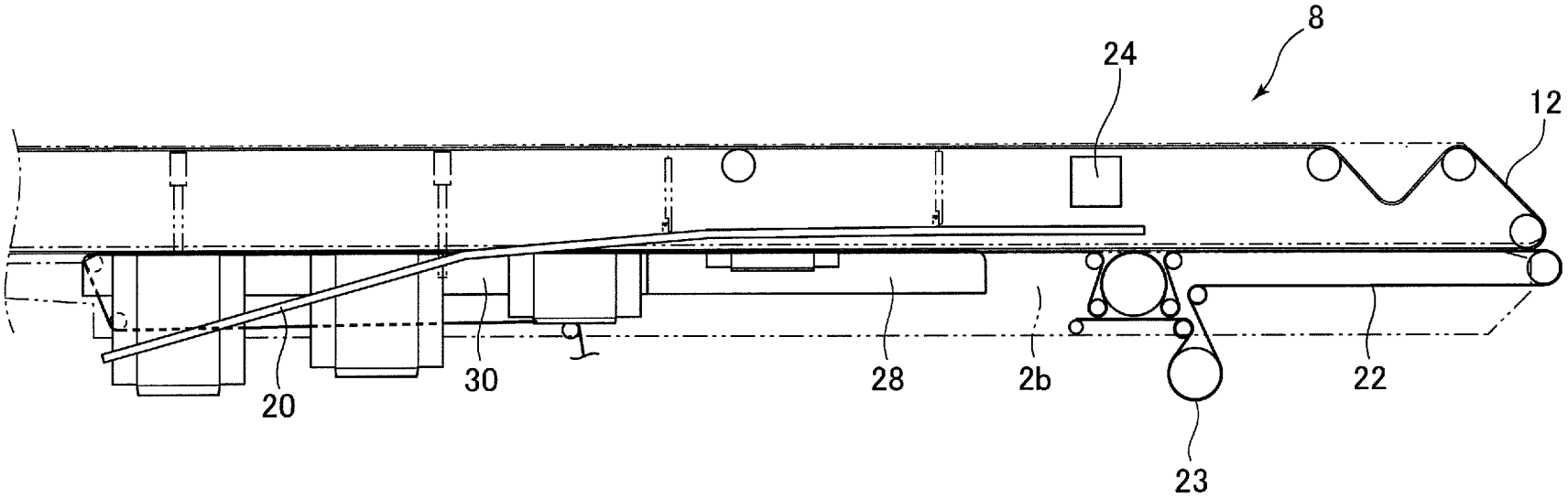
FIG. 5 is a side view illustrating the first bending station in a state in which the corrugated paperboard sheet is being bent by the folder-gluer according to this embodiment.
Figure 6:
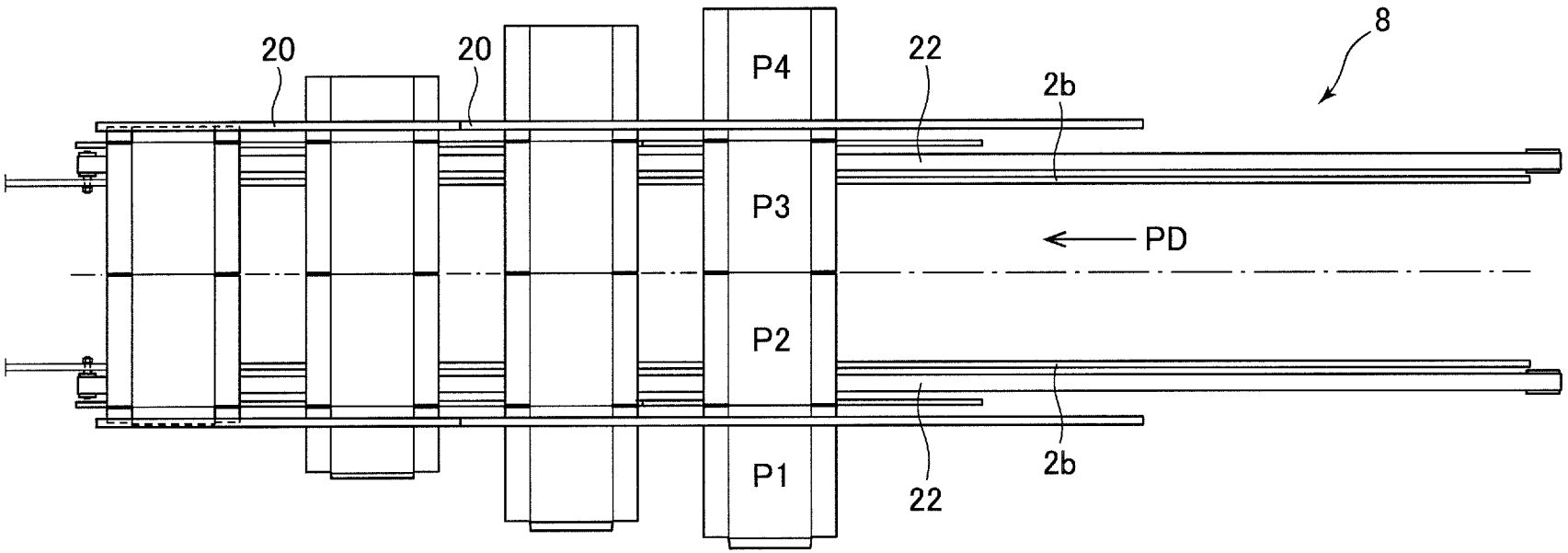
FIG. 6 is a top plan view illustrating the first bending station in FIG. 5.
Figure 7:
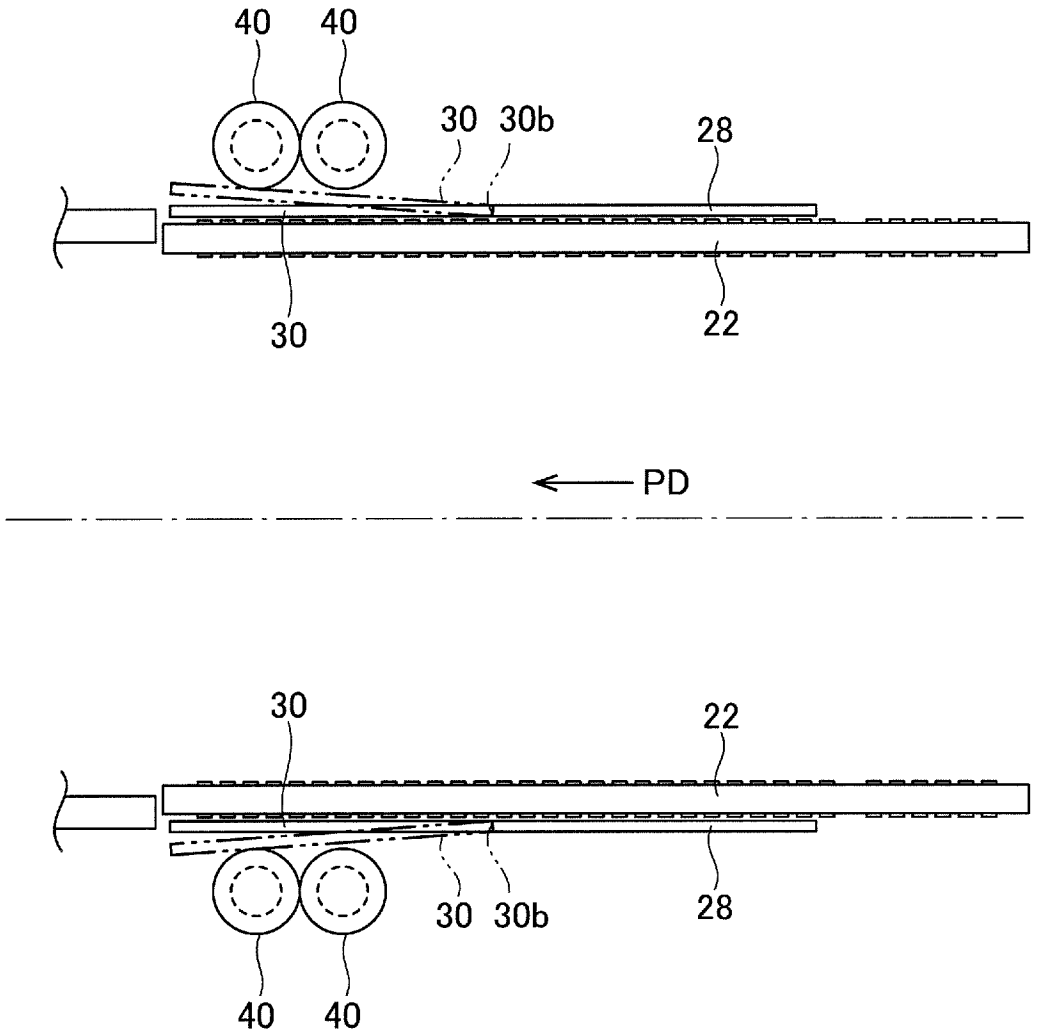
FIG. 7 is a schematic top plan view illustrating a swinging movement of a second bending plate in the first bending station of the folder-gluer according to this embodiment.
Figure 8:
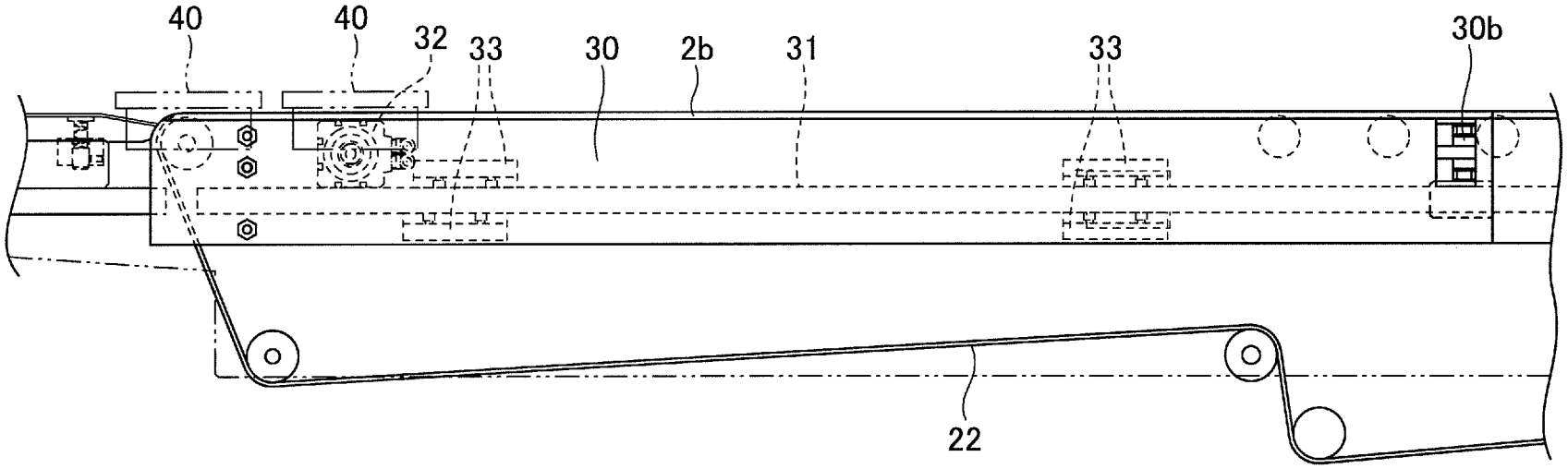
FIG. 8 is an enlarged side view illustrating the second bending plate in the folder-gluer according to this embodiment.
Figure 9:
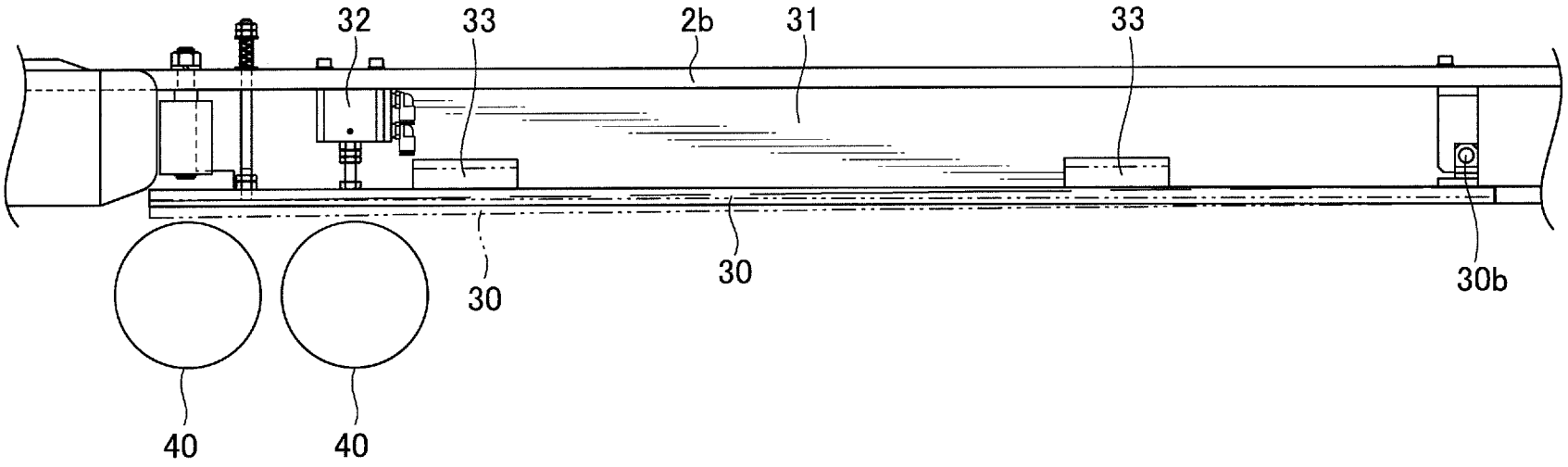
FIG. 9 is an enlarged top plan view illustrating the second bending plate in FIG. 8.
Figure 10:
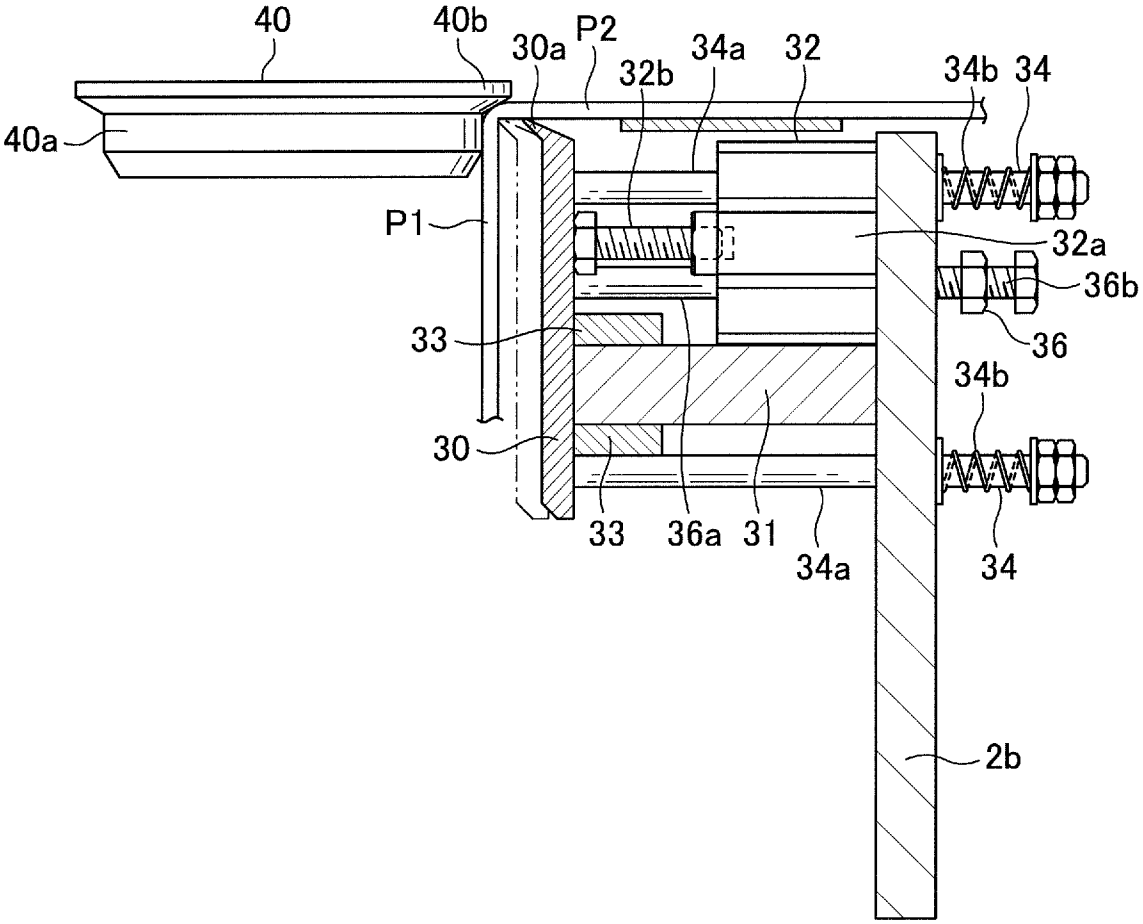
FIG. 10 is a front sectional view illustrating the second bending plate, a push-out device and others in the first bending station of the folder-gluey according to this embodiment.

With reference to FIGS. 3 to 10, the first bending station 8 of the folder-gluer 1 will be described below. FIG. 3 is a side view illustrating the first bending station, and FIG. 4 is a top plan view illustrating the first bending station in FIG. 3. FIG. 5 is a side view illustrating the first bending station in a state in which the corrugated paperboard sheet is being bent, and FIG. 6 is a top plan view illustrating the first bending station in FIG. 5. FIG. 7 is a schematic top plan view illustrating a swinging movement of a second bending plate in the first bending station. FIG. 8 is an enlarged side view illustrating the second bending plate in the folder-gluer according to this embodiment, and FIG. 9 is an enlarged top plan view illustrating the second bending plate in FIG. 8. FIG. 10 is a front sectional view illustrating the second bending die plate, a push-out device and others in the first bending station.

The first bending station 8 is designed to bend the endmost, first and fourth panels P1, P4 of the corrugated paperboard sheet SS from its flat state (0 degree) to about 90 degrees. The first bending station 8 is equipped with a pair of bending bars 20 disposed on both sides of the conveyance pathway PL, and a pair of lower conveyor belts 22 for conveying the corrugated paperboard sheet SS while supporting the corrugated paperboard sheet SS from therebelow.

Each of the bending bars 20 is disposed to extend from the corrugated paperboard sheet feed port of the folder-gluer 1 to an upstream region of the second bending station 10, and fixed to the upper frame 2*a* of the folder-gluer 1. An upstream portion of the bending bar 20 is located above the conveyance pathway PL, and the bending bar 20 is gradually lowered toward a downstream side to a position below the conveyance pathway PL. Thus, when an outer surface of each of the first and fourth panels P1, P4 comes into contact with a corresponding one of the bending bars 20, each of the first and fourth panels P1, P4 is bent from 0 degree to about 90 degrees. Each of the lower conveyor belts 22 are provided between the corrugated paperboard sheet feed port of the folder-gluer 1 and the upstream region of the second bending station 10, in a tensioned state, and configured to be driven by a drive pulley 23 so as to convey the corrugated paperboard sheet SS in cooperation with the pair of upper conveyor belts 12.

A leading edge detector 24 is attached to the upper frame 2*a* of the folder-gluer 1 at a position upstream of an aforementioned second bending plate 30, to detect the leading edge of the corrugated paperboard sheet SS being conveyed. The leading edge detector 24 is configured to optically detect passing of the leading edge FE of the corrugated paperboard sheet SS being conveyed.

As illustrated in FIGS. 3, 4, 7 and 10, in the first bending station 8, a pair of bending plates 26 are attached to the lower frame 2*b* at respective positions on both sides of the conveyance pathway PL. Each of the bending plates 26 comprises a first bending plate 28 disposed on an upstream side, and a second bending plate 30 disposed on a downstream side in continuous relation to the first bending plate 28.

Each of the first bending plates 28 is fixedly installed to the lower frame 2*b*, and configured such that a distal end 28*a* thereof has an edged shape, and comes into contact with a respective one of the crease line formed in a reverse surface of the panel P1 or a vicinity of the crease line, and the crease line formed in a reverse surface of the panel P4 or a vicinity of the crease line, to thereby facilitate bending an associated one of the panels P1, P4 along the crease line formed in the reverse surface thereof, in cooperation with a corresponding one of the bending bars 20.

As with the first bending plates 28, each of the second bending plates 30 is configured such that a distal end 30*a* thereof has an edged shape, and comes into contact with a respective one of the crease line K2 of the panel P1 or a vicinity thereof, and the crease line K4 of the panel P4 or a vicinity thereof (see FIG. 16), to thereby facilitate bending an associated one of the panels P1, P4 along the crease line thereof, in cooperation with a corresponding one of the bending bars 20.

A length of each of the second bending plates 30 in the conveyance direction is set to become greater than the box depth dimension CNL (see FIG. 2) of the corrugated paperboard sheet SS.

As illustrated in FIGS. 7 to 10, each of the second bending plates 30 is configured such that a downstream portion thereof is swingingly movable outwardly in the width direction by a given distance, about an upstream end thereof serving as a support point (rotational center) 30*b*. In this embodiment, the lower frame 2*b* is fixedly provided with a rib 31 extending along each of the bending plates 28 horizontally and outwardly from the lower frame 2*b*. Correspondingly, a guide member 33 is connected to an inner surface of each of the second bending plates 30. The guide member 33 is disposed to sandwich the rib 31 from opposite sides thereof (see FIG. 10), in such a manner that it can be slidingly moved in the width direction with respect to the rib 31.

When each of the second bending plates 30 is slidingly moved outwardly in the width direction, the guide member 33 connected to the second bending plate 30 is slidingly moved with respect to the rib 31 fixed to the lower frame 2*b* in a horizontal posture. Thus, the second bending plate 30 is allowed to be moved only in a horizontal direction. Preferably, a movement distance (given distance) of each of the second bending plates 30 toward an outward side in the width direction is approximately one-half of a widthwise dimension of each of the slit-like slots S1, S2, S4, S6 of the corrugated paperboard sheet SS. Each of the first bending plates 28 and the second bending plates 30 is configured such that a widthwise position thereof can be adjusted depending on the widthwise distance CNW of the corrugated paperboard sheet SS by a widthwise positioning mechanism (not illustrated).

As illustrated in FIG. 10, in order to swingingly move each of the second bending plates 30 outwardly in the width direction, an air cylinder 32 serving as a push-out device is attached to the lower frame 2*b* in the vicinity of a downstream end of the second bending plate 30. The vicinity of the downstream end of the second bending plate 30 is a zone in which a bending angle of each of the panels P1, P4 of the corrugated paperboard sheet SS reaches about 90 degrees. The air cylinder 32 is operable, according to an on-off operation of a solenoid valve (not illustrated), to send high-pressure air into a cylinder 32*a* to thereby move a piston so as to cause a rod 32*b* to protrude outwardly in the width direction. Thus, the second bending plate 30 is moved outwardly in the width direction (to a position indicated by the two-dot chain line in FIG. 10) along with a sliding movement of the guide member 33 on a surface of the rib 31.

Further, a return mechanism 34 for returning the second bending plate 30 to its original position, and a stopper mechanism 36 for regulating an amount of push-out (widthwise movement) of the second bending plate 30 by the air cylinder 32, are provided in an installation position of each of the second bending plates 30 and a corresponding one of the air cylinders 32. The return mechanism 34 comprises: a rod member 34*a* having a distal end fixed to the inner surface of the second bending plate 30 and movable integrally with the swinging movement of the second bending plate 30; and a return spring 34*b* interposed between the rod member 34*a* and the lower frame 2*b*. After the second bending die plate 30 is pushed and moved outwardly in the width direction for a given time, it is returned to its original position (indicated by the solid line in FIG. 10) by the return mechanism 34.

The stopper mechanism 36 comprises: a rod member 36*a* having a distal end fixed to the inner surface of the second bending plate 30 and movable integrally with the swinging movement of the second bending plate 30; and a nut 36*b* provided between the rod member 36*a* and the lower frame 2*b* to function as a stopper. An amount of protrusion of the second bending plate 30 in the width direction can be determined by adjusting a widthwise position of the nut 36*b*.

In this case, the amount of protrusion of the second bending plate 30 in the width direction is determined depending on properties, such as size or material, of the corrugated paperboard sheet SS. The amount of protrusion is set to a larger value along with an increase in size of the corrugated paperboard sheet SS. The amount of protrusion is also set to a larger value along with an increase in hardness of a material for the corrugated paperboard sheet SS.

As illustrated in FIGS. 4, 7, 8 and 9, in a zone adjacent to the downstream end of each of the second bending plates 30, two drive wheels 40 are provided on each side of the conveyance pathway PL. The two drive wheels 40 are provided along the conveyance direction of the corrugated paperboard sheet at a position where a bending angle of each of the panels P1, P4 of the corrugated paperboard sheet SS reaches 80 to 90 degrees. Each of the drive wheels 40 has an integral structure of a cylindrical portion 40*a* located on a lower side, and a parallel flange portion 40*b* located on an upper side. The drive wheel 40 is driven such that a rotational speed thereof becomes equal to a speed of each of the lower conveyor belts 22.

The drive wheel 40 is configured such that, when the air cylinder 32 pushes out the second bending plates 30 in the width direction by a given distance, an outer peripheral surface of the cylindrical portion 40*a* and a lower surface of the parallel flange portion 40*b* are kept in contact with the outside surface of an associated one of the panels P1, P4 at a position corresponding to a fold line thereof, to thereby reliably establish a contact of the distal end 30*a* of the second bending plates 30, so that it becomes possible to facilitate bending of an associated one of the panels P1, P4 of the corrugated paperboard sheet SS.

The drive wheel 40 may not be provided, since the above-mentioned bending bars 20 are provided in the zone adjacent to the downstream end of each of the second bending plates 30.

Figure 11:
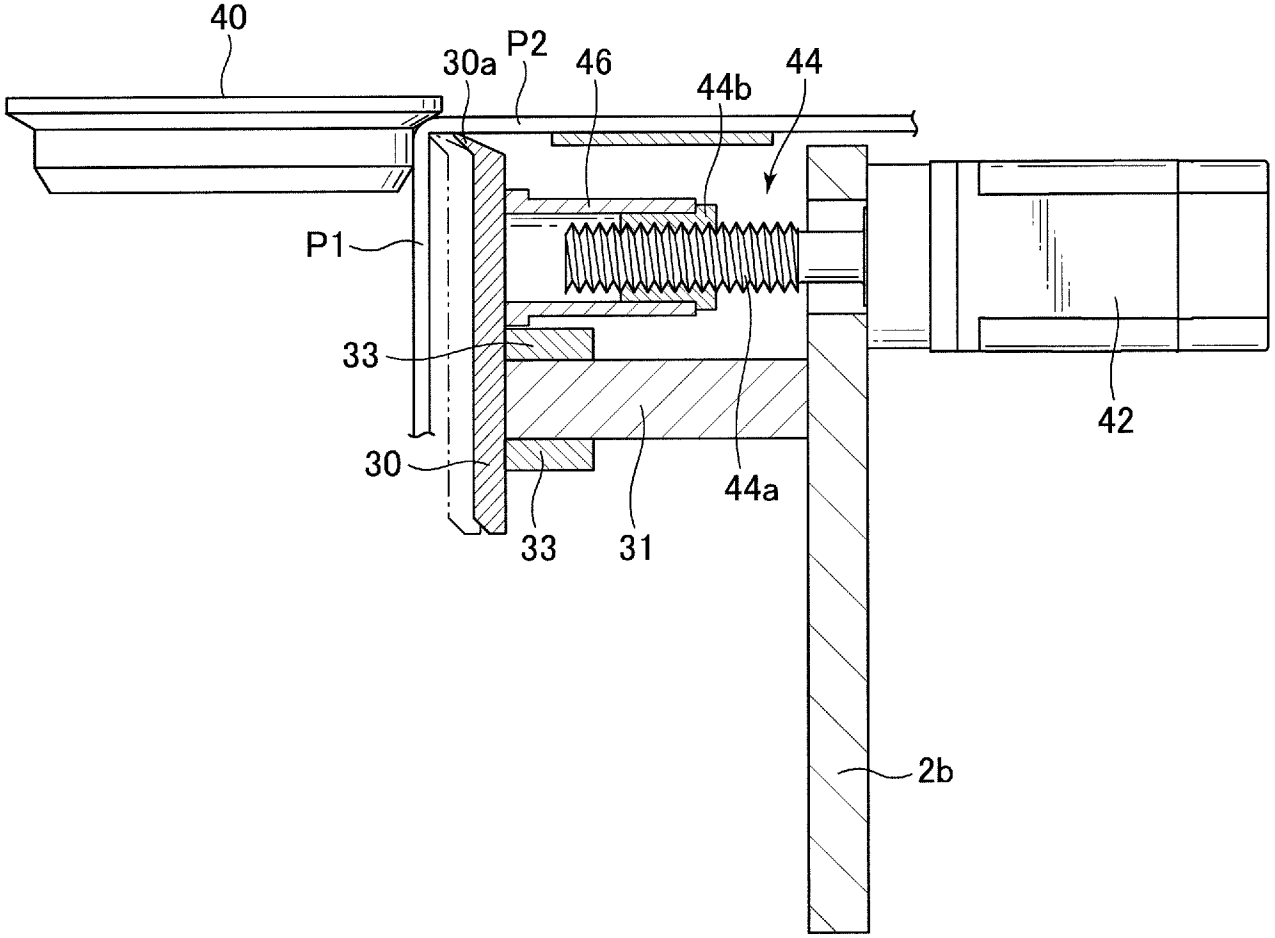
FIG. 11 is a front sectional view illustrating one modification of the push-out device in the folder-gluer according to this embodiment.

With reference to FIG. 11, one modification of the push-out device for pushing the second bending plate 30 outwardly in the width direction will be described below. Instead of an air cylinder as in the above embodiment, a servomotor 42 may be employed. Specifically, the push-out device may comprise the servomotor 42 and a threaded shaft mechanism 44. The servomotor is attached to an inner surface of the lower frame 2*b*. An externally-threaded shaft 44*a* is connected to a rotary shaft of the servomotor 42, and an internally-threaded shaft 44*b* is screwed onto the externally-threaded shaft 44*a* and fixed to the inner surface of the second bending plate 30 through a connection member 46. By moving the internally-threaded shaft 44*b* of the threaded shaft mechanism 44 in the width direction according to rotation of the servomotor 42, the second bending plate 30 to which the internally-threaded shaft 44*b* is fixed can be moved outwardly in the width direction. Further, by rotating the servomotor 42 in the reverse direction so as to return the internally-threaded shaft 44*b* to its original position, the second bending plate 30 can be moved to its original position.

Figure 12:
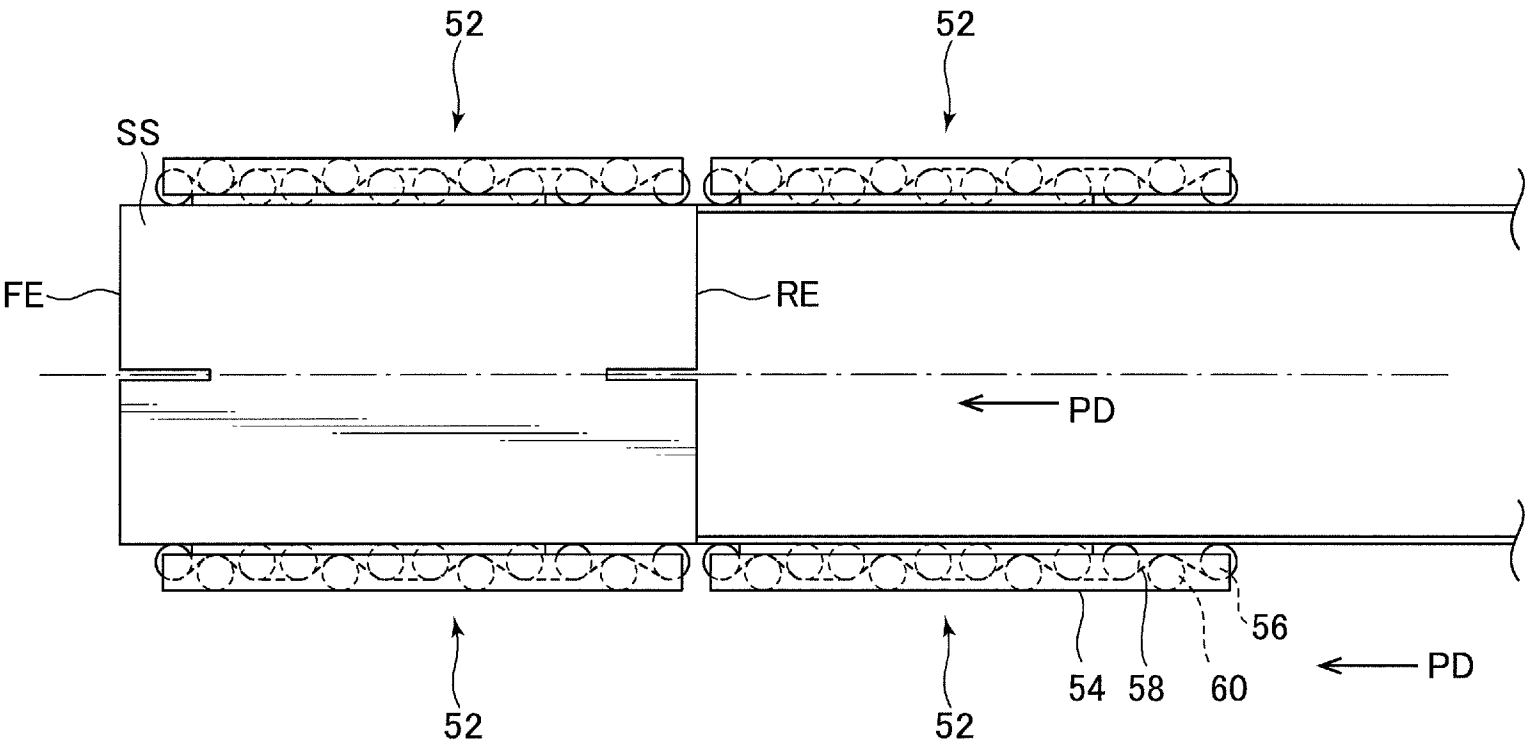
FIG. 12 is a top plan view illustrating a second bending station of the folder-gluer according to this embodiment.
Figure 13A:
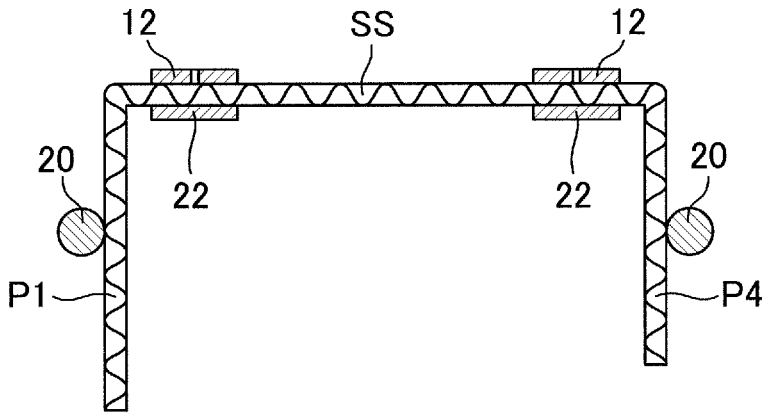
FIG. 13A is a sectional view illustrating a bent state of the corrugated paperboard sheet at a downstream end of the first bending station.
Figure 13B:
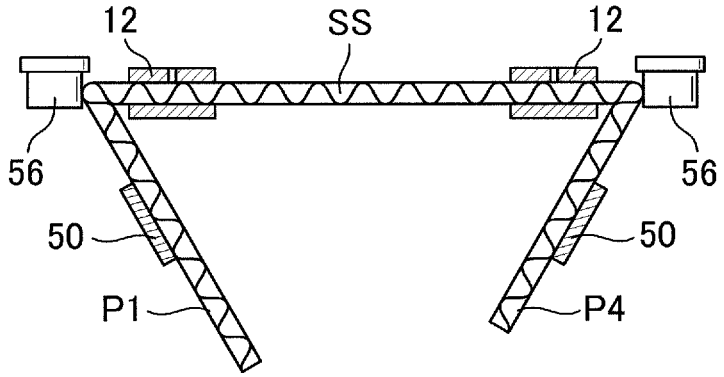
FIGS. 13B, 13C and 13D are, respectively, sectional views illustrating bent states of the corrugated paperboard sheet in the second bending station.
Figure 13C:
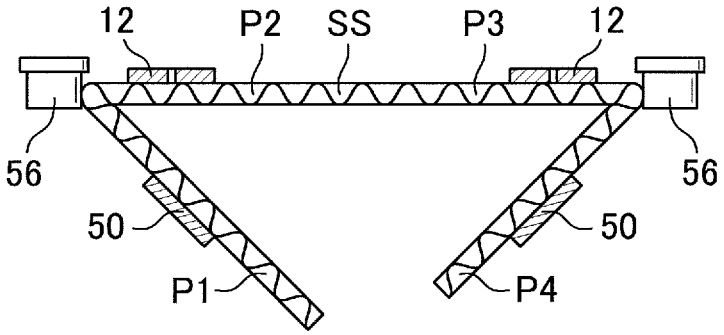
Figure 13D:
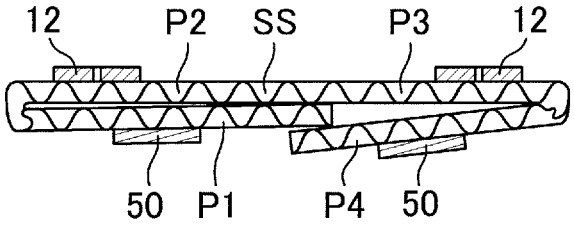

With reference to FIGS. 1, 12 and 13, the second bending station 10 of the folder-gluer 1 according to this embodiment will be described below.

As illustrated in FIG. 1, the second bending station 10 is equipped with: a pair of panel bending belts 50 disposed, respectively, on left and right sides of the conveyance pathway PL, and configured to be driven so as to bend the first and fourth panels P1, P4 of the corrugated paperboard sheet SS, respectively, from about 90 degrees to 180 degrees; and two sets of a pair of guiding and regulating mechanisms 52 arranged along the conveyance direction, and configured to guide and regulate the bent connection regions of the first and fourth panels P1, P4.

Each of the panel bending belts 50 is disposed to extend over the overall length of the second bending station 10, wherein it has a contact surface contactable with an outer surface of an associated one of the first and fourth panels P1, P4. Each of the panel bending belts 50 is wound around a large number of rollers 50*a* in a tensioned state, in such a manner that the contact surface of the panel bending belt 50 positioned in a vertically standing posture at an upstream end of the second bending station 10 in the conveyance direction PD is gradually inclined as being moved toward a downstream side, and finally positioned in a horizontal posture (see FIGS. 13A, 13B and 13C). A distance between the panel bending belts 50 in the sheet width direction WD can be adjusted depending on the given widthwise distance CNW of the corrugated paperboard sheet SS.

As illustrated in FIG. 12, the two sets of a pair of guiding and regulating mechanisms 52 are provided, respectively, on upstream and downstream sides of the second bending station 10. The upstream and downstream sets are structurally the same, and the pair of guiding and regulating mechanisms 52 on the right and left sides in the conveyance direction PD are also structurally the same. Each of the pair of guiding and regulating mechanisms 52 comprises: a support plate 54 fixed to the frame 2 of the folder-gluer 1; a group of eight gauge rolls 56 supported by the support plate 54; and a positioning mechanism (not illustrated) for variably positioning the support plate 54 in the sheet width direction WD.

The eight gauge rolls 56 are arranged in a line along the conveyance direction PD, and rotatably supported by a lower surface of the support plate 54. The eight gauge rolls 56 are configured to be rotated by a drive motor (not illustrated) via a timing belt 58 and three tension pulleys 60. The support plate 54 is configured to be moved in the sheet width direction (right-left direction) and positioned depending on the given widthwise distance CNW of the corrugated paperboard sheet SS. As illustrated in FIGS. 12 and 13, a pair of the groups of gauge rolls 56 are configured such that, during the operation of bending the corrugated paperboard sheet SS from about 90 degrees to 180 degrees, they come into contact with respective fold lines of the panels P1, P4 to regulate a widthwise movement of the corrugated paperboard sheet SS, and smoothly convey the corrugated paperboard sheet SS along the conveyance direction PL.

Figure 14:
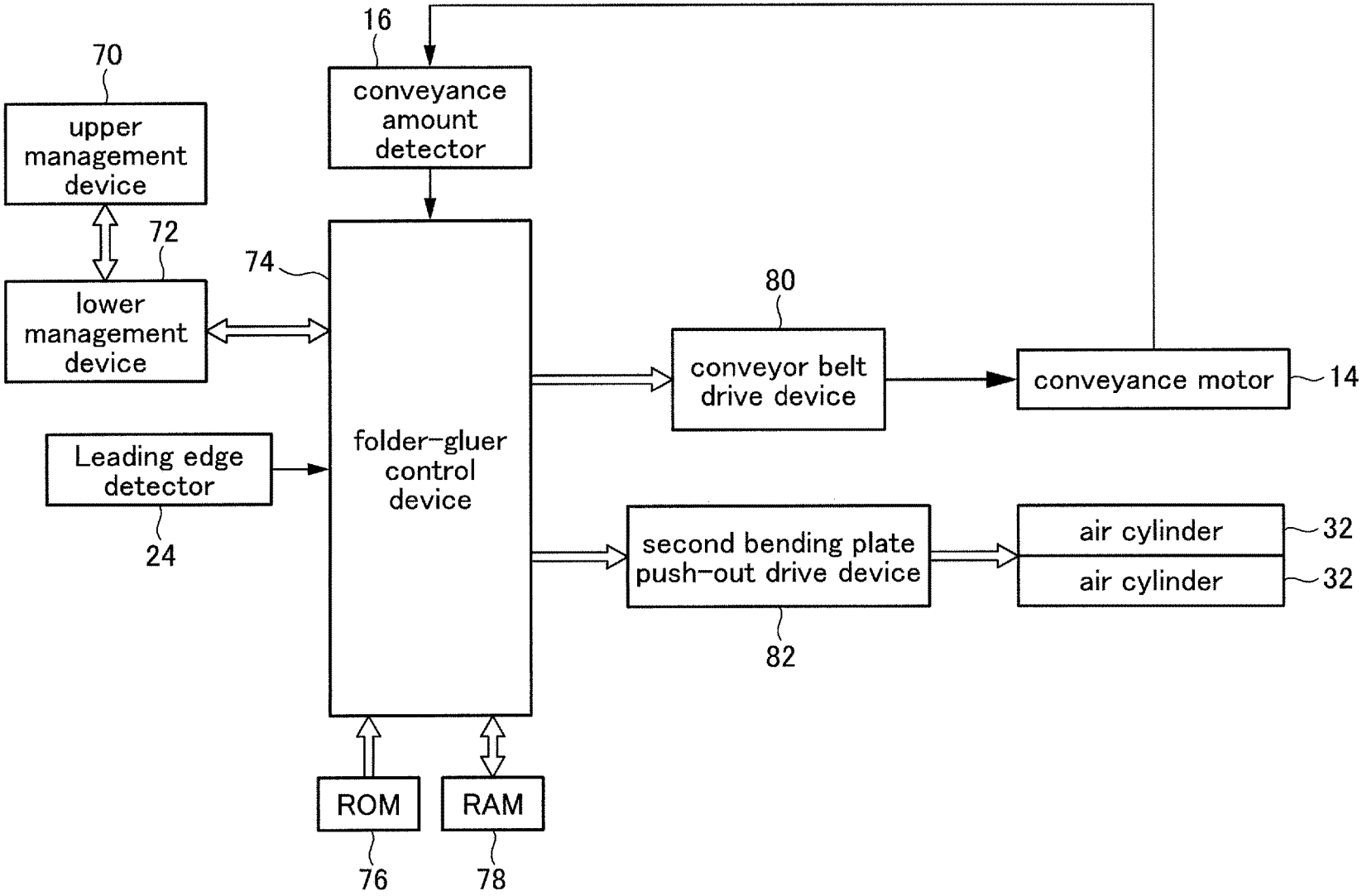
FIG. 14 is a block diagram illustrating an electrical configuration of the folder-gluer according to this embodiment.

With reference to FIG. 14, an electrical configuration (control system) of the folder-gluer 1 according to this embodiment will be described. As illustrated in FIG. 14, in order to comprehensively manage processing of corrugated paperboard sheets in the corrugated paperboard box making machine, an upper management device 70 and a lower management device 72 are provided. In regard to the folder-gluer 1, the upper management device 70 is operable, according to a predetermined processing management plan for a large number of orders, to send, to the lower management device 72, control instruction information regarding a rotational speed of each main motor, a size of a corrugated paperboard sheet, a required number of processed products, etc.

The lower management device 72 is designed to cause various processing units of the corrugated paperboard box making machine to operate, according to the control instruction information from the upper management device 70. In this connection, operations of processing units other than the folder-gluer 1 according to this embodiment are known. Thus, in FIG. 14, any control system for controlling the operations of processing units other than the folder-gluer 1 is omitted, and only an electrical configuration concerning a control system for the folder-gluer 1 is illustrated.

Control instruction information necessary for an operation of the folder-gluer 1 is supplied from the upper management device 70 to a folder-gluer control device 74. For example, the control instruction information includes information such as a conveyance speed, a size of each portion of the corrugated paperboard sheet SS, properties of the corrugated paperboard sheet SS, and a required number of processed products. The folder-gluer control device 74 is connected to: a ROM 76 storing therein a program such a main control program for controlling an entirety of the folder-gluer 1, and set values; and a RAM 78 for temporarily storing therein a result of computational operation. The folder-gluer control device 74 is connected to a conveyor belt drive device 80 and a second bending plate push-out drive device 82.

The folder-gluer control device 74 is also connected to: the conveyance amount detector 16 for detecting the conveyance amount from the conveyance motor 14; and the leading edge detector 24 for detecting passing of the leading edge FE of the corrugated paperboard sheet SS, so as to receive detection pulse signals indicative of the conveyance amount, and a detection signal indicative of passing of the leading edge. The folder-gluer control device 74 is provided with an internal counter for counting the detection pulse signals from the conveyance amount detector 16 to measure the conveyance amount. The internal counter is configured to start a counting operation in response to a measurement instruction generated by control operation of the folder-gluer control device 74.

In the folder-gluer 1 according to this embodiment, the second bending plate push-out drive device 82 is operable to receive, from the folder-gluer control device 74, a push-out control instruction directing a movement of the second bending plates 30 toward an outward side in the width direction, and activate the air cylinders 32 in accordance with the instruction.

Figure 15:
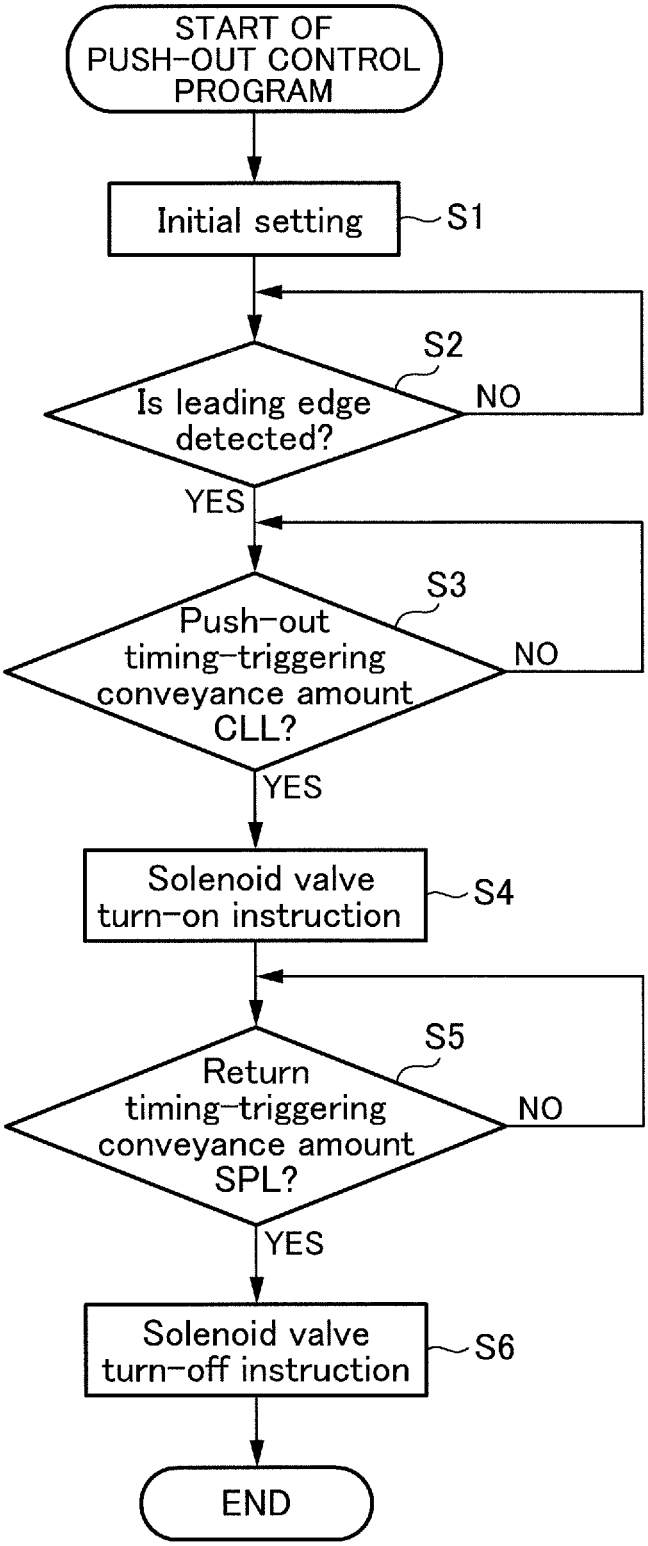
FIG. 15 is a flowchart illustrating contents of control to be executed by a second bending plate push-out drive device in the folder-gluer according to this embodiment.

The ROM 76 stores therein a push-out control program illustrated in FIG. 15. The push-out control program is designed to determine a "push-out timing" at which the second bending die plates 30 on the right and left sides of the conveyance pathway PL are pushed outwardly in the width direction, and a "return timing" at which the second bending die plates 30 are returned to their original positions.

An operation of the folder-gluer 1 according to this embodiment will be described below. First of all, the upper management device 70 supplies, to the lower management device 72, control instruction information necessary for executing a given order, e.g., information for directing a conveyance speed of the corrugated paperboard sheet SS, a size of each portion of the corrugated paperboard sheet SS, and a required number of processed products. The lower management device 72 supplies control instruction information to the folder-gluer control device 74.

Subsequently, initial setting is performed to clear contents of the ROM 78. The control instruction information is supplied from the lower management device 72 and stored in the RAM 78. For example, the control instruction information includes an instruction for a speed of the conveyance motor 14 corresponding to the conveyance speed of the corrugated paperboard sheet SS, an instruction regarding activation of the air cylinders 32 for a movement of the second bending plates 30 toward an outward side in the width direction, size information indicative of the size of each portion of the corrugated paperboard sheet SS, information indicative of the required number of processed products for the given order, and information about a distance between the pair of right and left groups of gauge rolls 56.

Subsequently, the positioning mechanism (not illustrated) sets the distance between the right and left groups of gauge rolls 56 in the pair of guiding and regulating mechanisms 52, in such a manner as to become equal to a given guide distance necessary for guiding and regulating the connection regions of the first and fourth panels of the corrugated paperboard sheet SS.

Subsequently, the conveyance motor 14 is driven in such a manner that a conveyance speed of the upper conveyor belts 12 becomes equal to a given speed directed by the speed instruction information. The conveyance motor 14 is also driven in such a manner that a speed of the corrugated paperboard sheet SS fed by the gauge rolls 56 becomes equal to the conveyance speed of the upper conveyor belts 12.

Subsequently, when a corrugated paperboard sheet SS in a flat state as illustrated in FIG. 2 is fed from the creaser-slotter unit (not illustrated) to the folder-gluer 1 through the feed port thereof, the corrugated paperboard sheet SS is conveyed in the conveyance direction PD while being sandwiched between the upper conveyor belts 12 and the lower conveyor belts 22.

Subsequently, in the first bending station 8, the glue application device 6 applies glue to a joint flap GS of the corrugated paperboard sheet SS being conveyed. Then, the first and fourth panels P1, P4 of the corrugated paperboard sheet SS are bent from the flat state, i.e., 0 degree, to approximately 90 degrees, respectively, by the pair of bending bars 20. During the operation of bending the corrugated paperboard sheet SS from 0 degree to approximately 90 degrees, the second bending plates 30 are moved outwardly in the width direction by the air cylinders 32 to prevent the occurrence of the fishtail, although details thereof will be described later.

Subsequently, the corrugated paperboard sheet SS bent to approximately 90 degrees is moved to the second bending station 10, and conveyed toward the downstream side by the upper conveyor belts 12 under a condition where the given guide distance GDW is maintained by the gauge rolls 56. In this process, the corrugated paperboard sheet SS is bent from approximately 90 degrees (about 90 degrees) to 180 degrees by the panel bending belts 50. Then, the glued corrugated paperboard sheet SS is discharged from the folder-gluer 1, and accumulated in the counter-ejector unit as the next processing unit.

With reference to FIGS. 7, 10, 14, 15 and 16, an operation for pushing and moving each of the second bending plates 30 outwardly in the width direction by a corresponding one of the air cylinders 32 will be described below. FIG. 15 is a flowchart illustrating contents of control to be executed by the second bending die plate control device in the folder-gluer according to this embodiment. In this flowchart, S demotes each step.

As illustrated in FIG. 15, upon start of the push-out control program, in S1, initial setting is performed to reset the measuring internal counter of the folder-gluer control device 74.

Subsequently, the program advances to S2, wherein it is determined whether or not the leading edge detector 24 detects passing of the leading edge FE of the corrugated paperboard sheet SS. When it is determined, in the S2, that passing of the leading edge FE has not been detected, the determination on the detection will be repeated. In a period of time during which the determination on the detection is repeated, the measuring internal counter counts the detection pulse signals generated from the conveyance amount detector 16 along with conveyance of the corrugated paperboard sheet SS.

On the other hand, when it is determined, in the S2, that passing of the leading edge FE is detected, the program advances to S3, wherein it is determined whether or not a content of the measuring internal counter reaches a push-out timing-triggering conveyance amount CLL stored in the RAM 78. When it is determined that the content of the measuring internal counter has not reached the push-out timing-triggering conveyance amount CLL, the determination on the conveyance amount in the S3 will be repeated.

As used here, the term "push-out timing-triggering conveyance amount CLL" means a conveyance amount in which a downward most point of the box depth dimension CNL of the corrugated paperboard sheet SS reaches a position of an upstream one of the drive wheels 40.

On the other hand, when it is determined, in the S3, that the content of the measuring internal counter reaches the push-out timing-triggering conveyance amount CLL, the program advances to S4, wherein an ON instruction for activating the solenoid valve (not illustrated) for the air cylinders 32 is supplied to the second bending plate push-out drive device 82. As a result of activation of the air cylinders 32, the pair of second bending plates 30 are moved outwardly in the width direction, so that respective downstream region of the fold lines of the panels P1, P4 are shifted outwardly in the width direction. In this process, according to the bending bars 20, the panels P1, P4 are bent to reach a bending angle of about 90 degrees. Further, the cylindrical portion 40*a* and the parallel flange portion 40*b* of each of the drive wheels 40 come into contact with the outside surfaces of an associated one of the panels P1, P4 at a position corresponding to a fold line thereof to prevent uplift of the associated one of the panels P1, P4, which would otherwise occur during bending thereof.

After issuing the solenoid valve turn-on instruction in the S4, the program advances to S5, wherein it is determined whether or not the content of the measuring internal counter reaches a return timing-triggering conveyance amount SPL stored in the RAM 78. When it is determined that the content of the measuring internal counter has not reached the return timing-triggering conveyance amount SPL, the determination on the conveyance amount will be repeated.

As used here, the term "return timing-triggering conveyance amount SPL" means a conveyance amount in which an intermediate point of the box depth dimension CNL of the corrugated paperboard sheet SS reaches the position of an upstream one of the drive wheels 40.

Subsequently, the corrugated paperboard sheet SS is further conveyed, and, when it is determined, in the S5, that the content of the measuring internal counter reaches the return timing-triggering conveyance amount SPL, the program advances to S6, wherein an OFF instruction for deactivating the solenoid valve for the air cylinders 32 is supplied to the second bending plate push-out drive device 82. As a result of deactivation of the air cylinders 32, the pair of second bending plates 30 are moved inwardly in the width direction and returned to their original positions, and the push-out control program is terminated.

Functions and advantageous effects of the folder-gluer 1 according to the above embodiment will be described below. The folder-gluer 1 according to the above embodiment comprises: a conveyance device 4 configured to convey the corrugated paperboard sheet SS; a pair of bending bars 20 configured to come into contact with respective outside surfaces of the first panel P1 and the fourth panel P4 of the corrugated paperboard sheet SS being conveyed to bend the first and fourth panels P1, P4 from 0 degree to about 90 degrees; a pair of panel bending belts 50 configured to come into contact with the respective outside surfaces of the first panel P1 and the fourth panel P2 to bend the first and fourth panels P1, P2 from about 90 degrees to 180 degrees; a pair of second bending plates provided in a zone where the first and fourth panels P1, P4 are bent from 0 degree to about 90 degrees, and configured such that distal ends 30*a* thereof come into contact, respectively, with a crease line K2 of the first panel P1 or a vicinity of the crease line K2, and a crease line K4 of the fourth panel P4 or a vicinity of the crease line K4, wherein each of the second bending plates 30 is movable outwardly in a width direction by a given distance, by a push-out device such as an air cylinder or a servomotor; a leading edge detector 24 provided upstream of the second bending plates 30, and configured to detect a leading edge of the corrugated paperboard sheet SS being conveyed; and a second bending plate push-out drive device 82 configured to, during a given period of time after a position of the leading edge of the corrugated paperboard sheet being conveyed is detected by the leading edge detector 24, to control the push-out device such as an air cylinder to push and move each of the second bending plates 30 outwardly in the width direction by a given distance to thereby expand a downstream region of each of the first and fourth panels P1, P4 in the width direction.

In the folder-gluer 1 according to the above embodiment, in the zone where the first and fourth panels are bent from 0 degree to about 90 degrees, the pair of second bending plates 30 are moved outwardly in the width direction by a given distance, by the push-out device such as an air cylinder, so that, when the panels P1, P4 the corrugated paperboard sheet SS are bent from 0 degree to about 90 degrees by the bending bars 20, a downstream region of each of the first and fourth panels P1, P4 can be expanded in the width direction. Therefore, the folder-gluer 1 according to the above embodiment can prevent the occurrence of the conventional problem "fishtail".

Figure 16:
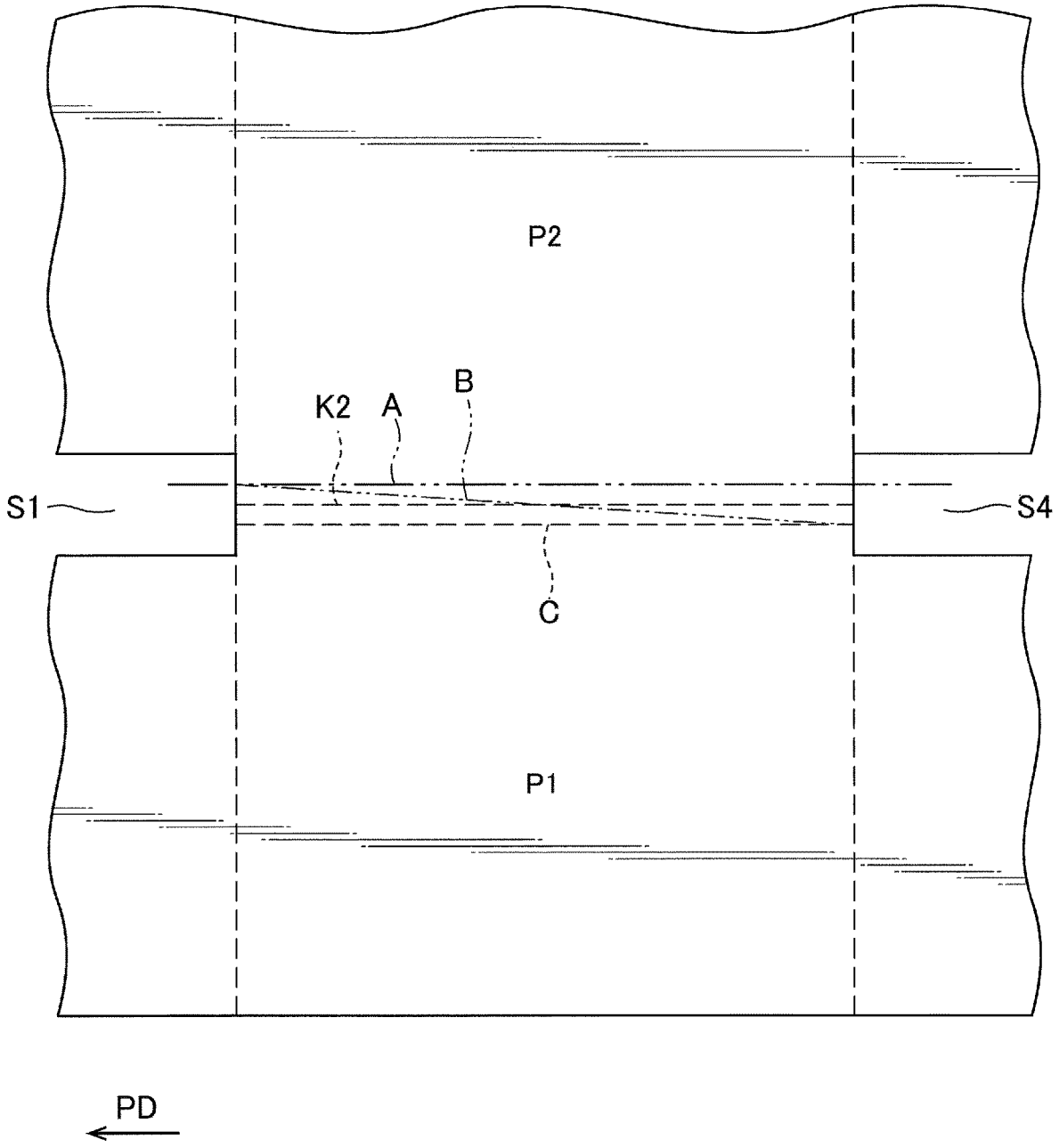
FIG. 16 is a top plan view illustrating a state after the corrugated paperboard sheet is folded by the folder-gluer according to this embodiment.
Figure 17:
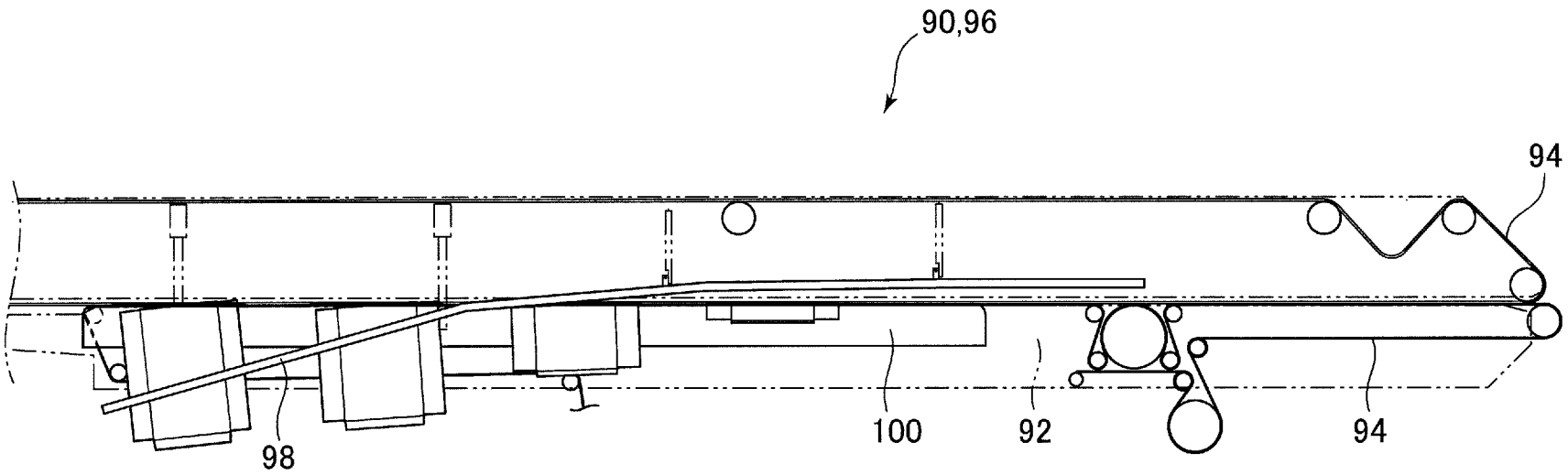
FIG. 17 is a side view of a first bending station of a conventional folder-gluer, illustrating a state in which the corrugated paperboard sheet is being bent by the conventional folder-gluer.
Figure 18:
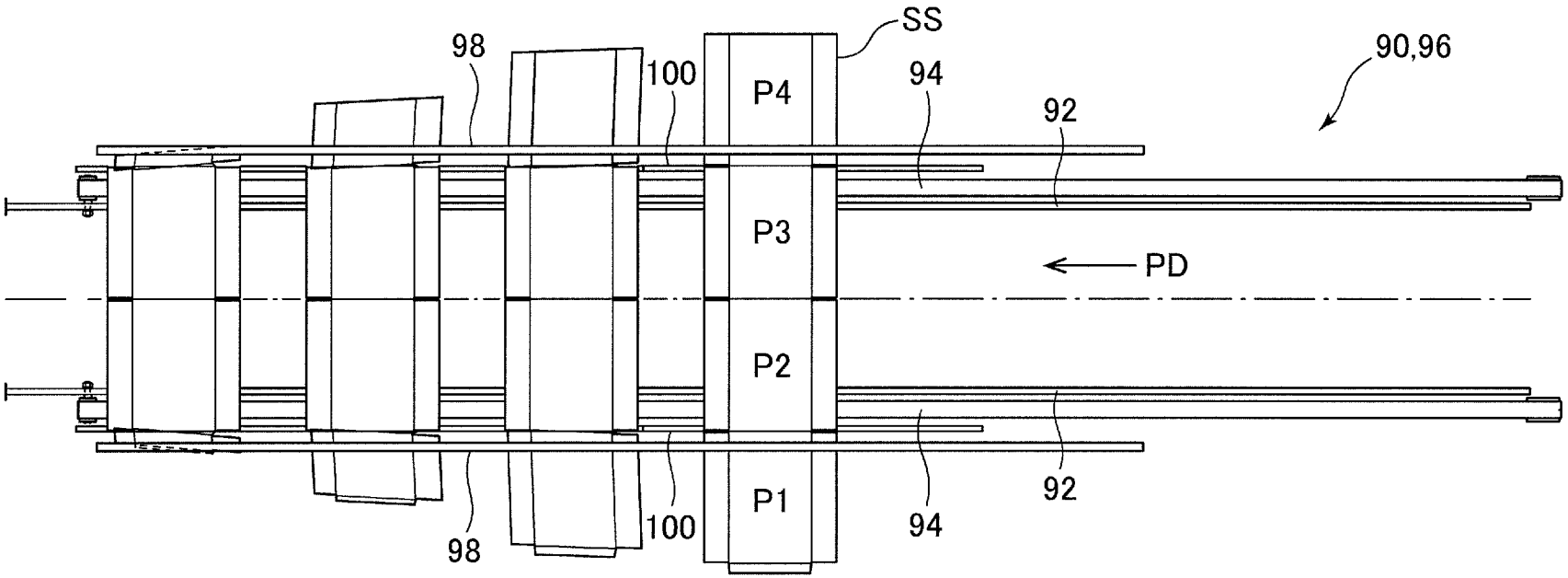
FIG. 18 is a top plan view illustrating the first bending station in FIG. 17.
Figure 19:
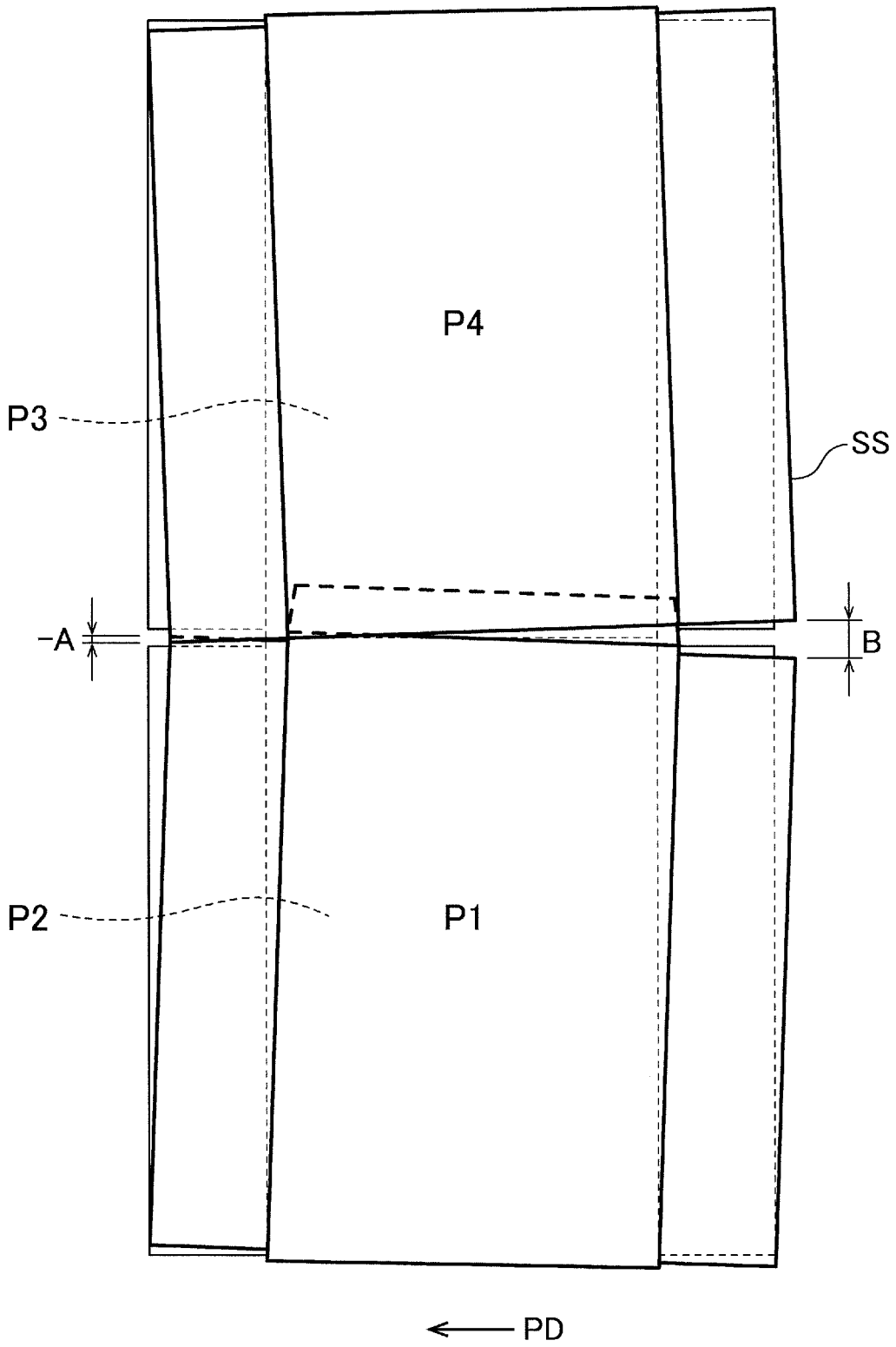
FIG. 19 is a back plan view illustrating fishtail occurring in the corrugated paperboard sheet folded by the conventional folder-gluer.

With reference to FIG. 16, the functions and advantageous effects will be more specifically described. FIG. 16 is a top plan view illustrating a state after the corrugated paperboard sheet SS is folded by the folder-gluer 1 according to the above embodiment. In FIG. 16, K2 indicates a crease line of the first panel P1, and A indicates a position of the distal end 30*a* of the second bending plate 30. In a corrugated paperboard sheet produced by a conventional folder-gluer, a fold line is formed in a fishtail shape which is obliquely expanded in a direction from the downstream side to the upstream side, as indicated by B. Differently, in the folder-gluer 1 according to the above embodiment, a fold line of the panel P1 is almost free from inclination in the direction from the downstream side to the upstream side, as indicated by C. This makes it possible to produce a box free from the fishtail.

In the folder-gluer 1 according to the above embodiment, an air cylinder is employed as the push-out device for pushing each of the second bending die plates 30 outwardly in the width direction, so that it becomes possible to provide the push-out device with a simple structure.

Alternatively, a servomotor may be employed. In this case, it becomes possible to accurately set an amount of movement toward an outward side in the width direction and easily change the movement amount.

In the folder-gluer 1 according to the above embodiment, each of the second bending die plates 30 is configured such that a downstream portion thereof is swingable in the width direction, about an upstream end thereof serving as a support point 30*b*.

Thus, in the folder-gluer 1 according to the above embodiment, each of the panels P1, P4 can be expanded outwardly in the width direction so as to allow a fold line of each of the panels P1, P4 to be inclined in a direction opposite to an inclination causing the occurrence of the fishtail. This makes it possible to more effectively prevent the occurrence of the fishtail.

The folder-gluer 1 according to the above embodiment further comprises a wheel member 40 provided widthwise outside each of the second bending plates 30, and configured to come into contact with the outside surface of an associated one of the first and fourth panels P1, P4 at a position of a fold line thereof.

Thus, in the folder-gluey 1 according to the above embodiment, while the panels P1, P4 are expanded outwardly in the width direction by the second bending plates 30, the wheel member 40 comes into contact with the outside surface of an associated one of the panels P1, P4 at a position of a fold line thereof, to thereby suppress uplift of the associated one of the panels P1, P4, which would otherwise occur during bending thereof. This makes it possible to more effectively prevent the occurrence of the fishtail.

Further, the wheel member 40 comprises a cylindrical portion and a flange portion, wherein an outer peripheral surface of the cylindrical portion and a lower surface of the flange portion come into contact with the outside surface of the associated one of the first and fourth panels at the position of the fold line thereof. Thus, it becomes possible to suppress uplift of the associated one of the panels P1, P4, which would otherwise occur during bending thereof, and more effectively prevent the occurrence of the fishtail.

The wheel member is provided in a zone where a bending angle of the corrugated paperboard sheet SS reaches about 90 degrees, i.e., at a position where the fishtail can occur. This makes it possible to reliably prevent the occurrence of the fishtail.

In the folder-gluer 1 according to the above embodiment, the wheel member is composed of a drive wheel, so that the wheel member 40 can suppress uplift of the associated one of the panels P1, P4, which would otherwise occur during bending thereof, while smoothly conveying the corrugated paperboard sheet SS. This makes it possible to more effectively prevent the occurrence of the fishtail.

In the folder-gluer 1 according to the above embodiment, a movement distance of each of the second bending plates 30 toward an outward side in the width direction is variable depending on properties of the corrugated paperboard sheet SS. This makes it possible to more reliably prevent the occurrence of the fishtail.

In the folder-gluer 1 according to the above embodiment, a length of each of the second bending plates 30 in a conveyance direction of the corrugated paperboard sheet is greater than a box depth dimension CNL of the corrugated paperboard sheet to be conveyed, so that it becomes possible to prevent the occurrence of the fishtail, over the overall length of the fold line of each of the panels P1, P4.

In the folder-gluer 1 according to the above embodiment, the push-out device such as an air cylinder 32 pushes each of the second bending plates 30 outwardly in the width direction by a given distance, in a period of time during which a downstream portion of the corrugated paperboard sheet SS having one-half of the box depth dimension CNL thereof passes through a position of the wheel member. Thus, it becomes possible to eliminate a situation triggering the formation of the fishtail.

In the folder-gluer 1 according to the above embodiment, a movement distance of each of the second bending plates 30 toward an outward side in the width direction is approximately one-half of a widthwise dimension of a slot of the corrugated paperboard sheet SS, so that it becomes possible to accurately prevent a certain level of fishtail which becomes a practical problem.

What is claimed is:

1. A folder-gluer for folding and gluing a corrugated paperboard sheet having first to fourth panels and a joint flap serially connected together in a width direction through respective connection regions, the folder-gluer operable to fold the first panel from the second panel along the connection region therebetween and the fourth panel from the third panel along the connection region therebetween and gluing the folded first and fourth panels together with the joint flap glued on the first or forth panel, the folder-gluer comprising:

a conveyance device configured to convey the corrugated paperboard sheet in a conveying direction, wherein the corrugated paperboard sheet being conveyed is oriented so that the width direction of the corrugated paperboard sheet is in perpendicular to the conveying direction;

a pair of first bending devices arranged opposite, in the width direction, to each other in a first conveyor segment, the pair of first bending devices configured to come into contact with outside surfaces of the first panel and the fourth panel of the corrugated paperboard sheet being conveyed and bend the first and fourth panels from 0 degree to about 90 degrees, respectively, from the second and third panels;

a pair of second bending devices arranged opposite, in the width direction, to each other in a second conveyor segment downstream of the pair of first bending devices, the pair of second bending devices configured to come into contact with the outside surfaces of the first panel and the fourth panel of the corrugated paperboard sheet being conveyed and bend the first and fourth panels from about 90 degrees to 180 degrees, respectively, from the second and third panels;

a pair of plate members provided in the first conveyor segment opposite in the width direction to each other, the pair of plate members having edge lines arranged, respectively, on the pair of plate member opposite to each other in the width direction, the pair of plate members being configured to move outwardly in the width direction so that the edge lines are to move away from each other in the width direction to come into contact, respectively, with a reverse surface of the corrugated paperboard sheet along a crease line formed between the first panel and the second panel, or in a vicinity of the crease line, and with the reverse surface of the corrugated paperboard sheet along a crease line formed between the fourth panel and the third panel, or in a vicinity of the crease line, wherein the pair of plate members; in cooperation with the pair of first bending devices, facilitate folding of the first and fourth panels, from 0 degree to about 90 degrees, from the second and third panels along the crease line between the first and second panels and the crease line between the third and fourth panels;

a detection device provided upstream of the plate members, and configured to detect a position of the corrugated paperboard sheet being conveyed;

push-out devices configured to push the pair of plate members away from each other in the width direction and thereby move the pair of plate members obliquely outwardly toward downstream of the first conveyor segment so that a distance in the width direction between the pair of plate members is wider on a downstream side of the pair of plate members than a distance therebetween on an upstream side thereof, wherein when the push-out devices push and move the pair of plate members obliquely outwardly, the edge lines are positioned obliquely outwardly toward downstream of the pair of plate members so that the edge lines come in contact with the crease lines obliquely along the crease lines to thereby move downstream regions of the first and fourth panels away from each other in the width direction; and a control device configured to operate the push-out devices, during a given period of time after the position of the corrugated paperboard sheet being conveyed is detected by the detection device, to push and move the pair of plate members away from each other in the width direction.

2. The folder-gluer according to claim 1, which further comprises wheel members provided opposite, in the width direction, to each other outside the pair of plate members, the opposite wheel members configured to come into contact with the outside surfaces of the first and fourth panels near positions where the first and fourth panels are folded.

3. The folder-gluer according to claim 2, wherein each of the wheel members comprises a cylindrical portion and a flange portion provided on an upper side of the cylindrical portion, and wherein each of the wheel member is configured such that an outer peripheral surface of the cylindrical portion and a lower surface of the flange portion come into contact with the outside surface of the first or fourth panel.

4. The folder-gluer according to claim 2, wherein each of the wheel members is provided in the conveying direction at a position where a bending angle of the corrugated paperboard sheet reaches 80 to 90 degrees.

5. The folder-gluer according to claim 2, wherein each of the wheel members comprises a drive wheel configured to rotate to convey the corrugated paperboard sheet in the conveying direction.

6. The folder-gluer according to claim 1, wherein the push-out devices comprise air cylinders, respectively, configured to push and move the pair of plate members away from each other in the width direction by means of high-pressure air.

7. The folder-gluer according to claim 1, wherein the push-out devices comprise servomotors, respectively, configured to push and move the pair of plate members away from each other in the width direction.

8. The folder-gluer according to claim 1, wherein a control device is configured to operate the push-out devices to adjust a distance of the pair of plate members in the width direction according to properties of the corrugated paperboard sheet.

9. The folder-gluer according to claim 1, wherein the pair of plate members has a dimension in the conveying direction greater than a box depth dimension of the corrugated paperboard sheet to be conveyed.

10. The folder-gluer according to claim 2, wherein the control device is configured to operate the push-out devices to push and move the pair of plate members away from each other in the width direction while a downstream one-half of a box depth dimension of the corrugated paperboard sheet passes at the wheel members.

11. The folder-gluer according to claim 1, wherein thy: control device is configured to operate the push-out devices to push and move the pair of plate members away from each other in the width direction until the downstream ends of the pair of bending plate members reach one-half of a widthwise dimension of a slot of the corrugated paperboard sheet.

* * * * *